US011859621B2

(12) United States Patent
Harrison et al.

(10) Patent No.: US 11,859,621 B2
(45) Date of Patent: Jan. 2, 2024

(54) INTERSTAGE CAPACITY CONTROL VALVE WITH SIDE STREAM FLOW DISTRIBUTION AND FLOW REGULATION FOR MULTI-STAGE CENTRIFUGAL COMPRESSORS

(71) Applicant: TRANE INTERNATIONAL INC., Davidson, NC (US)

(72) Inventors: Mark W. Harrison, Onalaska, WI (US); Jon Christopher Johnson, New Albin, IA (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 18/069,675

(22) Filed: Dec. 21, 2022

(65) Prior Publication Data

US 2023/0130511 A1 Apr. 27, 2023

Related U.S. Application Data

(63) Continuation of application No. 17/453,456, filed on Nov. 3, 2021, now Pat. No. 11,536,277, which is a (Continued)

(51) Int. Cl.
*F04D 27/00* (2006.01)
*F04D 17/12* (2006.01)
(Continued)

(52) U.S. Cl.
CPC ..... *F04D 17/122* (2013.01); *F04D 29/444* (2013.01); *F04D 29/462* (2013.01); *F04D 29/684* (2013.01)

(58) Field of Classification Search
CPC .... F04D 17/122; F04D 27/003; F04D 27/005; F05D 2260/60
See application file for complete search history.

(56) References Cited

U.S. PATENT DOCUMENTS 3,362,625 A 1/1968 Endress
3,619,078 A 11/1971 Mount
(Continued)

FOREIGN PATENT DOCUMENTS

CN 113586504 A 11/2021
EP 3171034 A1 5/2017
(Continued)

OTHER PUBLICATIONS

Extended European Search Report, European Patent Application No. 21170478.8, dated Sep. 22, 2021 (5 pages).
(Continued)

*Primary Examiner* — Eldon T Brockman
*Assistant Examiner* — Andrew J Marien
(74) *Attorney, Agent, or Firm* — Hamre, Schumann, Mueller & Larson, P.C.

(57) ABSTRACT

Centrifugal compressors can incorporate a side stream flow of intermediate pressure vapor between stages of that compressor. The side stream flow can be controlled by a side stream injection port controlled by a throttle ring disposed between stages of the compressor. The throttle ring can allow or obstruct flow through the side stream injection port. The throttle ring can extend and retract in a direction substantially perpendicular to the direction of flow from the first stage impeller to the second stage impeller. A method of operating a centrifugal compressor can include actuating a throttle ring by rotating a drive ring to adjust a flow of interstage fluid into the second stage impeller.

19 Claims, 21 Drawing Sheets

Related U.S. Application Data continuation-in-part of application No. 16/863,764, filed on Apr. 30, 2020, now Pat. No. 11,391,289.

(51) Int. Cl.

| | |
|---|---|
| ***F04D 29/46*** | (2006.01) |
| ***F04D 29/44*** | (2006.01) |
| ***F04D 29/68*** | (2006.01) |

(56) References Cited

U.S. PATENT DOCUMENTS

| | | | |
|---|---|---|---|
| 4,460,310 | A | 7/1984 | Plunkett |
| 4,695,224 | A | 9/1987 | Lown |
| 6,293,103 | B1 | 9/2001 | Gladden |
| 6,872,050 | B2 | 3/2005 | Nenstiel |
| 7,025,557 | B2 | 4/2006 | Japikse et al. |
| 7,326,027 | B1 | 2/2008 | Skoch et al. |
| 7,553,122 | B2 | 6/2009 | Kirtley |
| 7,641,439 | B2 | 1/2010 | Chen |
| 7,905,102 | B2 | 3/2011 | Bodell et al. |
| 8,567,207 | B2 | 10/2013 | Sommer et al. |
| 8,632,302 | B2 | 1/2014 | Sorokes et al. |
| 9,353,765 | B2 | 5/2016 | Haley et al. |
| 9,382,910 | B2 | 7/2016 | Jan et al. |
| 9,382,911 | B2 | 7/2016 | Sun et al. |
| 9,388,815 | B2 | 7/2016 | Chen et al. |
| 2004/0109757 | A1 | 6/2004 | Nenstiel |
| 2007/0147987 | A1 | 6/2007 | Kirtley |
| 2012/0186605 | A1 | 7/2012 | Nakaniwa |
| 2014/0341710 | A1 | 11/2014 | Creamer |
| 2015/0128640 | A1 | 5/2015 | Sun et al. |
| 2017/0198724 | A1 | 7/2017 | Konno |
| 2018/0119569 | A1 | 5/2018 | Masuda |
| 2019/0024528 | A1 | 1/2019 | Baldassarre et al. |
| 2019/0285072 | A1 | 9/2019 | Masutani et al. |
| 2020/0109720 | A1 | 4/2020 | Turner et al. |

FOREIGN PATENT DOCUMENTS

| | | |
|---|---|---|
| JP | S60-132099 | 7/1985 |
| JP | 3653005 | 5/2005 |
| KR | 100814619 | 3/2008 |
| WO | 2013/165841 | 11/2013 |
| WO | 2017/007708 | 1/2017 |

OTHER PUBLICATIONS

Extended European Search Report; European Patent Application No. 22204569.2, dated Mar. 13, 2023 (11 pages).

INTERSTAGE CAPACITY CONTROL VALVE WITH SIDE STREAM FLOW DISTRIBUTION AND FLOW REGULATION FOR MULTI-STAGE CENTRIFUGAL COMPRESSORS

FIELD

This disclosure is directed to an interstage capacity control valve for a centrifugal compressor, particularly one providing side stream flow regulation or distribution.

BACKGROUND

Multi-stage compressors can use single-row or multiple-row, fixed or rotatable return vanes to direct and/or control interstage flow, when operated at full and partial load conditions. These return vans can, at partial load conditions lead to low-momentum zones in return channel passages or adverse pressure gradients that alter the intended side stream injection flow rate, which can lead to compressor instability, reduced system efficiency, and result in narrower operating ranges.

SUMMARY

This disclosure is directed to an interstage capacity control valve for a centrifugal compressor, particularly one providing side stream flow regulation or distribution.

The interstage capacity control valve can simultaneously control flow between stages of a multi-stage compressor while regulating the addition of a side stream flow to that flow between stages. The interstage capacity control valve increases the velocity of the interstage flow where the side stream is added, avoiding stagnant areas of flow. This in turn can improve the stability and efficiency of the compressor at both partial and full load conditions.

The axial extension of the interstage capacity control valve further can reduce maintenance issues relating to the complexity of rotatable vane designs for capacity control in centrifugal compressors.

Further, embodiments can add the side stream flow at a comparatively low-pressure area in the interstage line, facilitating addition of the side stream and allowing more of the side stream to be successfully introduced. This can avoid cycling and compression of bypass gases In an embodiment, a centrifugal compressor includes a first stage impeller and a second stage impeller. The centrifugal compressor includes a side stream injection port located between the first stage impeller and the second stage impeller, the side stream injection port configured to receive a side stream of a fluid. The centrifugal compressor includes a capacity control valve. The capacity control valve is configured to extend and retract through the side stream injection port. The capacity control valve has a curved surface facing a direction of flow from the first stage impeller to the second stage impeller. The capacity control valve is configured to be extended through the side stream injection port between an open position where the side stream of the fluid can flow through the side stream injection port and a closed position where the capacity control valve obstructs flow of the side stream of the fluid through the side stream injection port.

In an embodiment, the capacity control valve has a ring shape.

In an embodiment, the centrifugal compressor includes a plurality of the side stream injection ports and a plurality of the capacity control valves.

In an embodiment, when in the open position, a tip of the capacity control valve at an end of the curved surface is within the side stream injection port.

In an embodiment, the capacity control valve extends and retracts in a direction substantially perpendicular to the direction of flow from the first stage impeller to the second stage impeller.

In an embodiment, the centrifugal compressor further includes one or more deswirl vanes between the first stage impeller and the second stage impeller. In an embodiment, the capacity control valve includes one or more notches, the one or more notches each configured to accommodate at least a portion of one of the one or more deswirl vanes. In an embodiment, the one or more deswirl vanes each include one or more notches, the one or more notches each configured to accommodate at least a portion of the capacity control valve.

In an embodiment, the capacity control valve has a linear meridional profile on a side opposite the curved surface, the linear meridional profile contacting an edge of the side stream injection port.

In an embodiment, a side of the capacity control valve opposite the curved surface is configured such that when the capacity control valve is between the open position and the closed position, the fluid can flow past the capacity control valve on the side of the capacity control valve opposite the curved surface. In an embodiment, the side of the capacity control valve opposite the curved surface includes a second curved surface. In an embodiment, the side of the capacity control valve opposite the curved surface includes one or more channels configured to allow flow of the side stream of the fluid.

In an embodiment, a heating, ventilation, air conditioning, and refrigeration (HVACR) circuit includes a centrifugal compressor, a condenser, an expander, and an evaporator. The centrifugal compressor includes a first stage impeller and a second stage impeller. The centrifugal compressor also includes side stream injection port located between the first stage impeller and the second stage impeller. The side stream injection port is configured to receive a side stream of a fluid. The centrifugal compressor further includes a capacity control valve. The capacity control valve is configured to extend and retract through the side stream injection port. The capacity control valve has a curved surface facing a direction of flow from the first stage impeller to the second stage impeller. The capacity control valve is configured to be extended through the side stream injection port between an open position where the side stream of the fluid can flow through the side stream injection port and a closed position where the capacity control valve obstructs flow of the side stream of the fluid through the side stream injection port.

In an embodiment, the side stream of the fluid is from the condenser to the side stream injection port.

In an embodiment, the HVACR circuit further includes an economizer and wherein the side stream of the fluid is from the economizer to the side stream injection port.

In an embodiment, the HVACR circuit further includes an intercooler and wherein the side stream of the fluid is from the intercooler to the side stream injection port.

In an embodiment, the capacity control valve has a ring shape.

In an embodiment, the capacity control valve has a linear meridional profile on a side opposite the curved surface, the linear meridional contacting an edge of the side stream injection port. In an embodiment, a side of the capacity control valve opposite the curved surface is configured such that when the capacity control valve is between the open position and the closed position, the fluid can flow past the capacity control valve on the side of the capacity control valve opposite the curved surface.

In an embodiment, a centrifugal compressor for compressing a fluid includes a first stage impeller, a second stage impeller, a plurality of guide vanes, a side stream injection port, a throttle ring, a drive ring, and linkage assemblies. The guide vanes forming channels located between the first stage impeller and the second stage impeller. The channels configured to direct an interstage flow of the fluid from the first stage impeller to the second stage impeller. The side stream injection port located between the first stage impeller and the second stage impeller and configured to receive a side stream of the fluid. The throttle ring is configured to move through the side stream injection port between an extended position and a retracted position. The linkage assemblies connect the drive ring to the throttle ring such that rotation of drive ring moves the throttling ring in the axial direction between the retracted position and the extended position. In the extended position, the throttle ring obstructs flow of the side stream of the fluid through the side stream injection port and partially obstructs the interstage flow of the fluid through the channels. In the retracted position, the throttle ring allows the side stream of the fluid to flow through the side stream injection port.

In an embodiment, the throttle ring includes teeth. In the extended position, the teeth are disposed in and obstruct the channels. In the retracted position, the throttle ring obstructs the side stream injection port.

In an embodiment, the teeth extend in the axial direction and include tips that curve radially inward.

In an embodiment, in the retracted position, the teeth of the throttle ring are disposed in the side stream injection port.

In an embodiment, the teeth of the throttle ring obstruct less of the channels in the retracted position than in the extended position, and the throttle ring obstructs more of the side stream injection port in the retracted position than in the extended position.

In an embodiment, in the retracted position, the fluid in the side stream flows over the throttle ring into the side stream injection port, and in the extended position, the fluid in the interstage flow passing through the channels by flowing across the tips of the teeth.

In an embodiment, in the retracted position, the throttle ring blocks the side stream injection port.

In an embodiment, in the retracted position: the interstage flow of the fluid from the first stage impeller has a higher flowrate in the extended position, and the side stream has a higher flowrate through the side stream injection port than in the extended position.

In an embodiment, the throttle ring includes radial shafts, and each of the linkage assemblies include pairs of a drive linkage and a support linkage connected to the radial shafts of the throttle ring. The drive linkage and the support linkage in each pair connects to the same respective one of the radial shafts on the throttle ring.

In an embodiment, the centrifugal compressor includes a housing, and the throttle ring, the drive ring, and the guide vanes are disposed within the housing. The drive linkages connect the drive ring to the throttle ring, and the drive linkages configured to transfer rotation of the drive ring into axial movement of the throttle ring. The support linkages connect the throttle ring to the housing, and the support linkages configured to prevent rotation of the throttle ring.

In an embodiment, the centrifugal compressor includes an actuator and an actuation linkage assembly connecting the actuator to the drive ring. The actuator is configured to extend causing the rotation of the drive ring and to retract causing an opposite rotation of the drive ring.

In an embodiment, method of operating a centrifugal compressor is for a centrifugal compressor that includes a first stage impeller, a second stage impeller, a plurality of guide vanes and a side stream injection port each respectively located between the first stage impeller and the second stage impeller, a throttle ring, a drive ring, and linkage assemblies connecting the drive ring to the throttle ring. The method includes compressing a fluid with the first stage impeller, directing, via channels formed by the plurality of guide vanes, an interstage flow of the fluid discharged from the first stage impeller to an inlet of the second stage impeller, and actuating a throttle ring to adjust a flow of the fluid in the interstage flow into the second stage impeller. The actuating of the throttle ring includes moving the throttle ring in an axial direction between a retracted position and an extended position by rotating the drive ring. The rotation of the drive ring causes the throttle ring to move in the axial direction. In the extended position, flow of the side stream of the fluid through the side stream injection port is obstructed by the throttle ring and flow of the interstage fluid through the channels is obstructed by the throttle ring. In the retracted position, the side stream of the fluid flows through the side stream injection port and into the inlet of the second stage impeller.

In an embodiment, the throttle ring includes teeth. The moving of the throttle ring in an axial direction between the retracted position and the extended position includes: moving the throttle ring from the retracted position to the extended position which moves the teeth into the channels, and moving the throttle ring from the extended position to the retracted position which withdraws the teeth from the channels.

In an embodiment, the moving of the throttle ring from the extended position to the retracted position includes moving the teeth along the axial direction into the side stream injection port.

In an embodiment, the centrifugal compressor includes an actuator and an actuation linkage assembly connecting the actuator to the drive ring. The moving of the throttle ring in the axial direction between the retracted position and the extended position by rotating the drive ring includes: extending the actuator to rotate the drive ring in a first direction, and retracting the actuator to rotate the drive ring in an opposite direction.

DRAWINGS

FIG. 9 shows the throttle ring in an extended position.

FIG. 10 shows the throttle ring in a reacted position.

FIG. 11 shows the throttle ring in a retracted position.

FIG. 12 shows the throttle ring in an extended position.

DETAILED DESCRIPTION

This disclosure is directed to an interstage capacity control valve for a centrifugal compressor, particularly one providing side stream flow regulation or distribution.

Figure 1A:
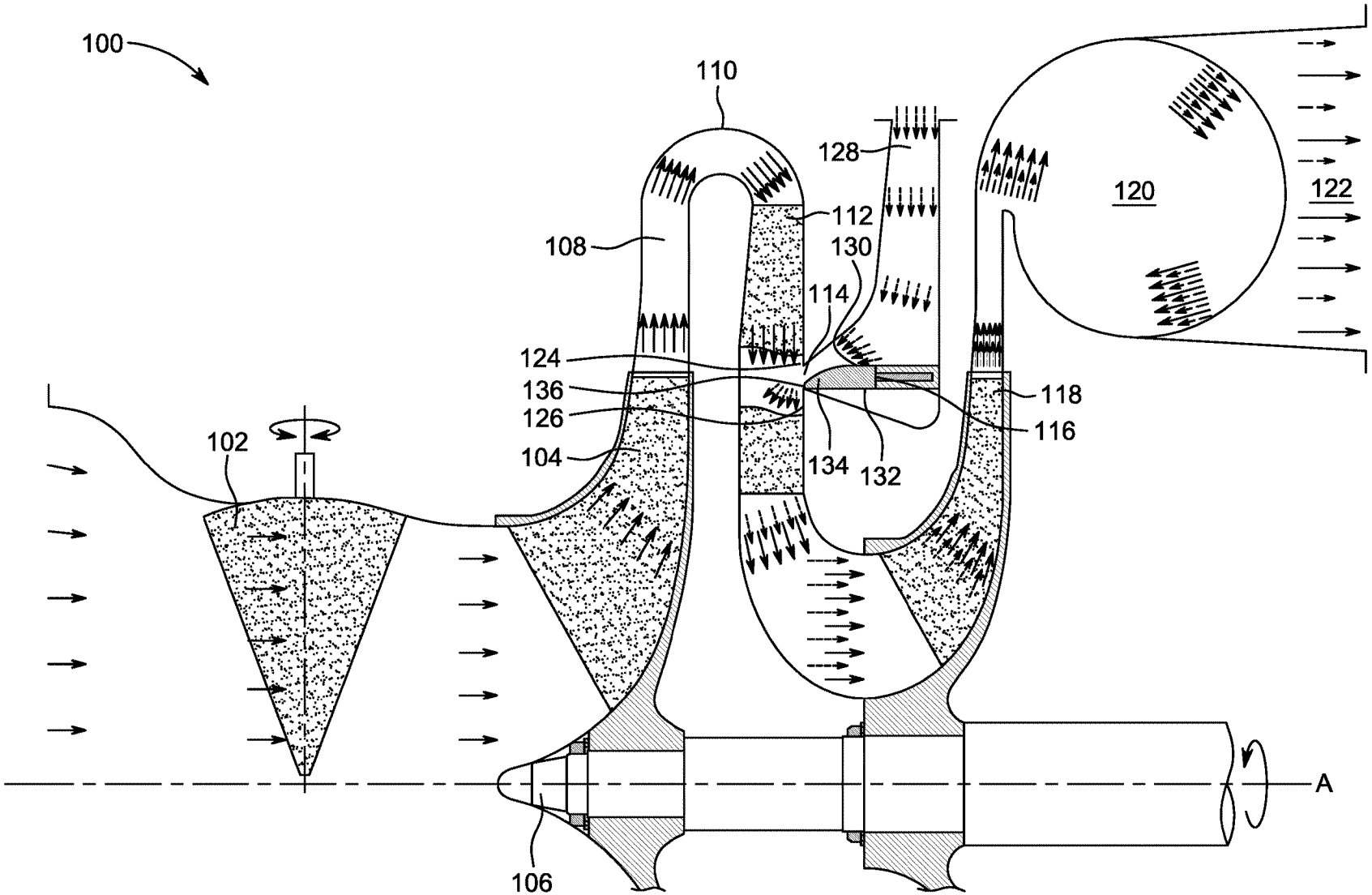
FIG. 1A shows a sectional view of a compressor according to an embodiment when a capacity control valve is in a fully open position.

FIG. 1A shows a sectional view of a compressor 100 according to an embodiment when a capacity control valve is in a fully open position. Compressor 100 can have a cylindrical structure such that the sectional view shown in FIGS. 1A-1D be repeated or continuous through 360° of rotation about axis A of the compressor 100.

Compressor 100 is a multi-stage centrifugal compressor according to an embodiment. Compressor 100 includes an inlet guide vane 102 where a core flow of fluid to be compressed is received. Compressor 100 includes a first stage impeller 104 driven by rotation of shaft 106, a diffuser 108 downstream of the first stage impeller 104, and a return bend 110 downstream of the diffuser 108. Compressor 100 further includes one or more deswirl vanes 112 downstream of the return bend 110. Compressor 100 includes a side stream injection port 114 and a capacity control valve 116. Compressor 100 includes a second stage impeller 118 downstream of the deswirl vanes 112 and the side stream injection port 114, with a volute scroll 120 and a discharge conic 122 downstream of the second stage impeller 118.

While compressor 100 is shown in FIGS. 1A-1D as a two-stage compressor, compressors according to embodiments can include any number of stages, with the side stream injection port 114 and the capacity control valve 116 are provided in an interstage flow path between any two stages of the compressor. For example, compressor 100 can be a three-stage compressor, with the side stream injection port 114 and capacity control valve 116 disposed between the exhaust of the second stage and the intake of the third stage, or the like.

Flow of working fluid into compressor 100 may be controlled using one or more inlet guide vanes 102. The one or more inlet guide vanes 102 can be configured to obstruct or permit flow of working fluid into the compressor 100. In an embodiment, each of the inlet guide vanes 102 can be a rotating vane, for example, each rotating vane forming a section of a circle such that when all rotating vanes are in a closed position, the inlet guide vanes 102 obstruct an inlet of the compressor 100. The one or more inlet guide vanes 102 can be movable between a fully open position and the closed position. In the fully open position the effect of the inlet guide vanes 102 on flow into compressor 100 can be minimized, for example by positioning the inlet guide vanes 102 such that the plane of each vane is substantially parallel to the direction of flow of working fluid into the inlet of compressor 100. In an embodiment, each or all of the one or more inlet guide vanes 102 can be varied continuously from the fully open position to the closed position, through one or more partially open positions.

Compressor 100 includes a first stage impeller 104. The first stage impeller 104 includes a plurality of blades. The first stage impeller 104 is configured to draw in the working fluid that passes the one or more inlet guide vanes 102 when rotated, and to expel the working fluid towards diffuser 108. The first stage impeller 104 is joined to shaft 106. Shaft 106 is rotated by, for example, a prime mover such as a motor.

Diffuser 108 receives the fluid discharged from first stage impellers 104 and directs the flow of the fluid towards return bend 110. Return bend 110 changes the direction of the flow of the fluid such that it travels through the deswirl vanes 112 towards the second stage impeller 118.

One or more deswirl vanes 112 are vanes extending from the return bend 110 towards the second stage impeller 118. The deswirl vanes 112 are shaped to straighten the flow of the fluid as the flow passes towards the second stage impeller 118. The deswirl vanes 112 can include notches configured to receive at least a portion of the capacity control valve 116.

Side stream injection port 114 is a port configured to allow a side stream to be introduced into the interstage flow of fluid through compressor 100. The side stream injection port 114 includes a leading end 124 and a trailing end 126, with the leading end 124 towards the return bend 110 and the trailing end 126 towards the second stage impeller 118. Side stream injection port 114 fluidly connects a side stream flow channel 128 with the interstage flow. The side stream flow channel 128 can receive a side stream of fluid from within a fluid circuit including the compressor 100. The source of the side stream of fluid received by side stream flow channel can be from one or more of a condenser, an economizer, an intercooler, a heat exchanger, or any other suitable source of fluid that is at an intermediate pressure, between the suction pressure and the discharge pressure of the compressor 100.

The side stream injection port 114 can be a ring shape surrounding an intake of the second stage impeller 118. The side stream injection port 114 can be provided between the return bend 110 and the second stage impeller 118.

Capacity control valve 116 is a valve configured regulate the flow through the side stream injection port 114. Capacity control valve 116 is configured to be extended axially through the side stream injection port 114 such that it extends substantially perpendicular to a direction of flow of the interstage flow from deswirl vane 110 towards the second stage impeller 118. Capacity control valve 116 is configured to be able to prohibit flow through side stream injection port 114 in a closed position, for example by including a portion having a thickness corresponding to the width of the side stream injection port 114 from leading end 124 to trailing end 126. In an embodiment, capacity control valve 116 is controlled in conjunction with inlet guide vanes 102. In an embodiment, capacity control valve 116 is controlled independently of inlet guide vanes 102.

Capacity control valve 116 includes a leading side 130 facing towards the return bend 110 and a trailing side 132 facing towards an inlet into second stage impeller 118. Leading side 130 includes curved surface 134 extending towards a tip 136 of the capacity control valve 116. The curved surface 134 can reduce the cross-sectional thickness of the capacity control valve 116 from a thickness corresponding to the width of the side stream injection port 114 at the base of the curved surface 134 to a smaller thickness at the tip 136. The change in the cross-sectional thickness of capacity control valve 116 over the length of curved surface 134 towards tip 136 is configured to vary the amount of flow through the side stream injection port based on the extension of the capacity control valve 116. In the embodiment shown in FIGS. 1A-1D, trailing side 132 can be, for example, a linear profile in the longitudinal direction of the capacity control valve 116 configured to always be in contact with trailing end 126 of the side stream injection port 114, such that all flow of the side stream into the interstage flow is over the leading side 130.

Where side stream injection port 114 has a ring shape, the capacity control valve 116 can have a corresponding ring shape. In an embodiment, the capacity control valve is a single ring. In an embodiment, the capacity control valve includes a plurality of ring segments. In an embodiment, the capacity control valve 116 includes one or more notches configured to avoid contact between the capacity control valve 116 and one or more deswirl vanes 112 as the capacity control valve 116 is extended. In an embodiment, the capacity control valve can be moved from a fully open position where the tip 136 is located within the side stream injection port 116 or the side stream channel 128, and a fully closed position, where the capacity control valve 116 obstructs the side stream injection port 114 from leading end 124 to trailing end 126.

In the fully open position of the capacity control valve 116, the tip 136 of the capacity control valve 116 does not extend through the side stream injection port 114. Accordingly, the interstage flow through the deswirl vane 112 is not obstructed, and obstruction of the side stream injection port 114 by the capacity control valve is at a minimum. The side stream fluid passes over the curved surface 134 to join the interstage flow between return bend 110 and second stage impeller 118. The fully open position can be used when the compressor 100 is operating at or near a full-load capacity.

Second stage impeller 118 is used to achieve the second stage of compression. Second stage impeller 118 draws in the combined interstage and side stream flows and expels the fluid towards volute scroll 120. Second stage impeller 118 can be rotated by shaft 106, which is also used to rotate first stage impeller 104. Fluid at the volute scroll 120 can then be discharged from compressor 100 at discharge conic 122.

In an embodiment, the side stream provided through side stream injection port 114 can be received from an economizer, such as the economizer 314 shown in FIG. 3B and described below. The economizer can be a flash-tank economizer, where flash or bypass gas rises and can be directed to the side stream flow channel 128. The gas from the economizer being directed to the side stream flow channel 128 can reduce or eliminate the presence of gas in the liquid being passed to an evaporator of the HVACR system including compressor 100. This can in turn improve the absorption of energy at the evaporator without further subcooling by providing more saturated liquid working fluid. In the full load cycle corresponding to the fully open position of capacity control valve 116, the pressure at the side stream injection port 114 can allow the entrained vapor to be substantially removed from the working fluid in the economizer.

Figure 1B:
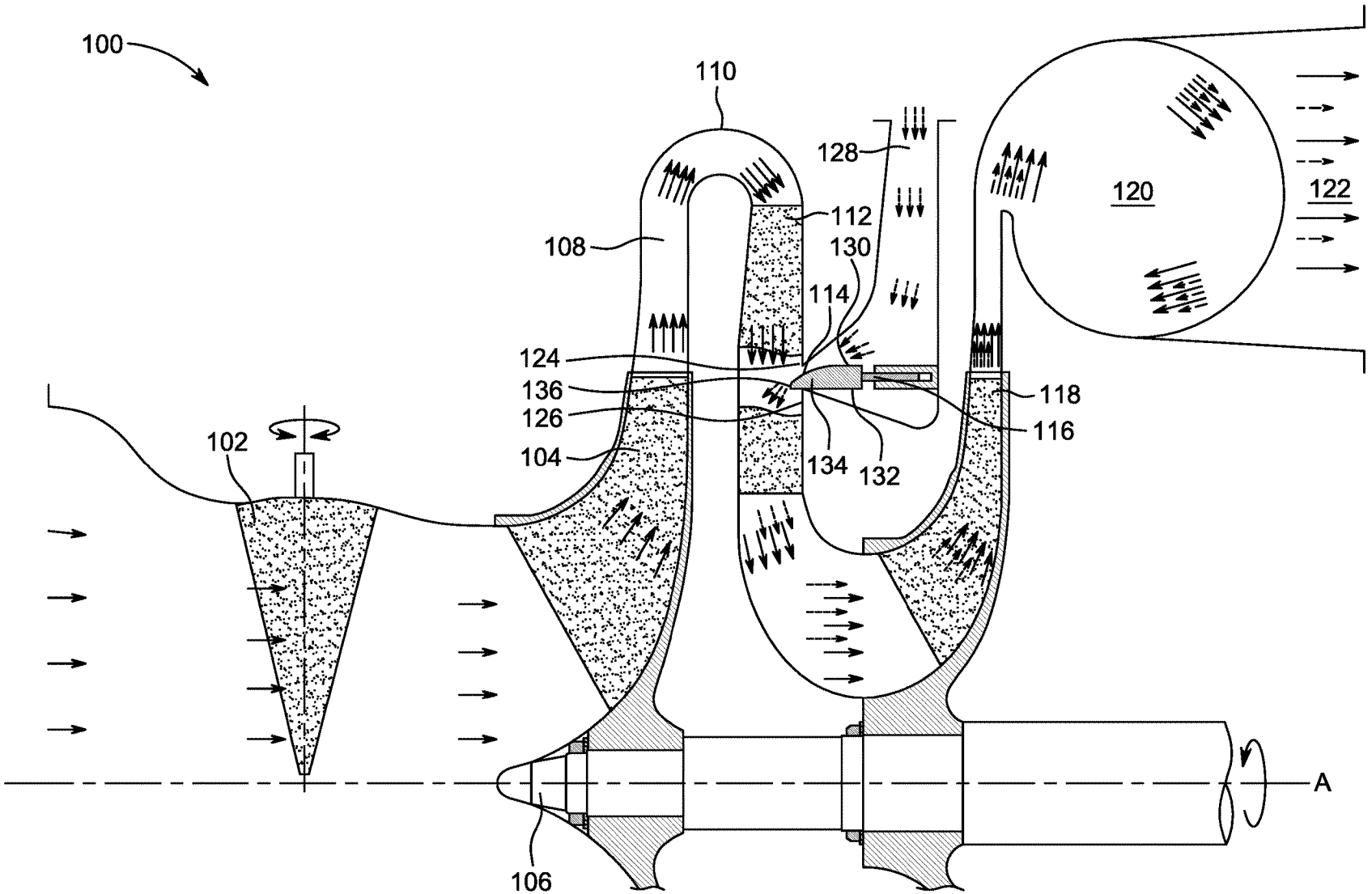
FIG. 1B shows a sectional view of the compressor shown in FIG. 1A when the capacity control valve is in a high flow position.

FIG. 1B shows a sectional view of the compressor shown in FIG. 1A when the capacity control valve 116 is in a high flow position. The high flow position shown in FIG. 1B can be used in a partial load condition where the load is relatively close to full load for the compressor 100. In the high flow position shown in FIG. 1B, the capacity control valve 116 is extended axially such that it partially extends through side stream injection port 114. The leading side 130 of the capacity control valve 116 partially deflects the interstage flow in compressor 100 due to the projection of the capacity control valve reducing the size of the passage for interstage flow. The capacity control valve 116 restricts flow through the side stream injection port to a greater extent than when in the fully-open position shown in FIG. 1A and described above, with curved surface 134 reducing the orifice size by being closer to the leading end 124 of the side stream injection port 114. The trailing side 132 of the capacity control valve 116 continues to be in contact with the trailing end 126 of the side stream injection port 114, and all flow through side stream injection port 114 passes between the leading end 124 of side stream injection port 114 and the leading side 130 of capacity control valve 116. Optionally, inlet guide vane 102 can be rotated to partially obstruct flow to the first stage impeller 104 of compressor 100.

Figure 1C:
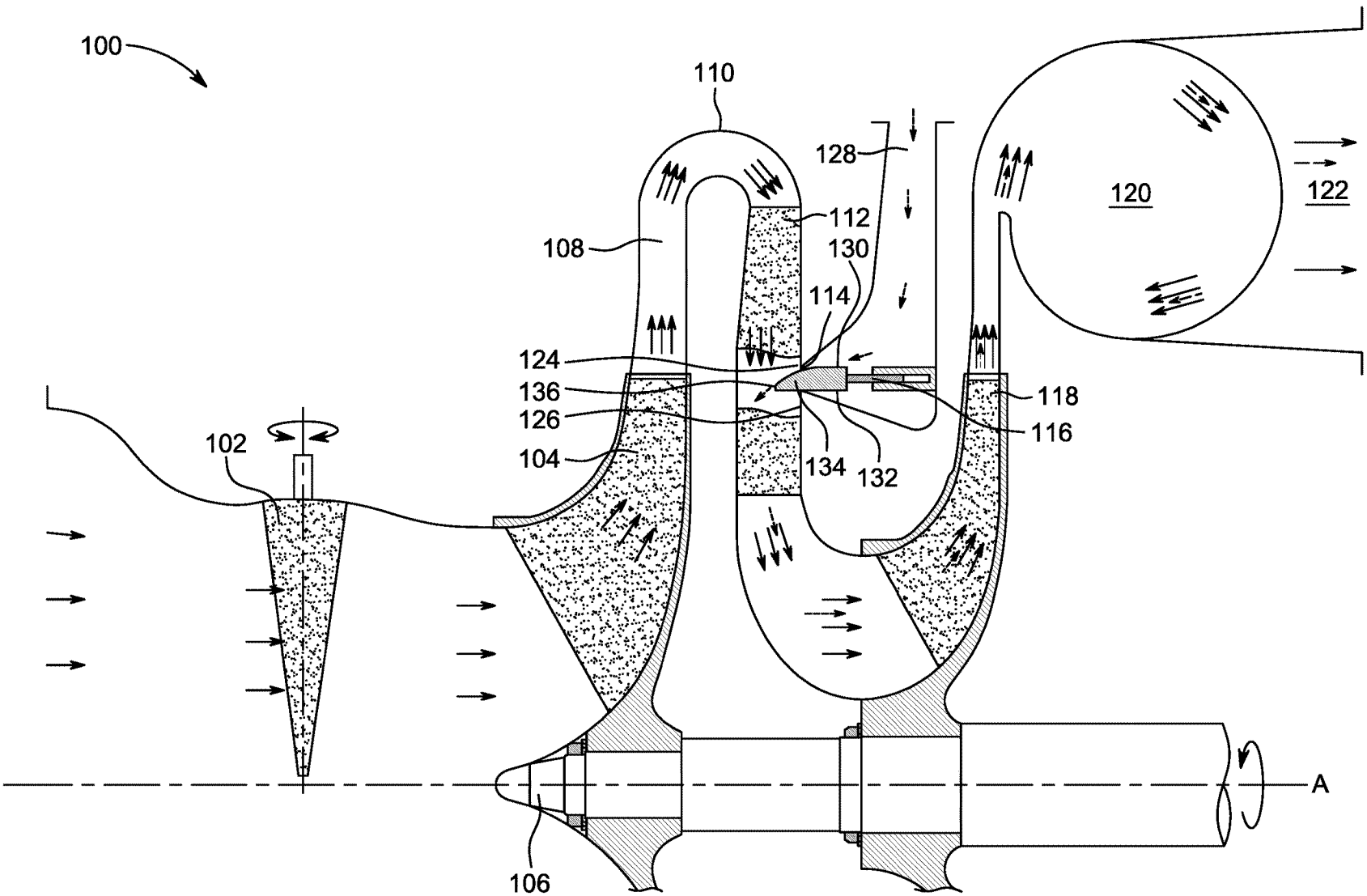
FIG. 1C shows a sectional view of the compressor shown in FIG. 1A when the capacity control valve is in a low flow position.

FIG. 1C shows a sectional view of the compressor shown in FIG. 1A when the capacity control valve is in a low flow position. The low flow position shown in FIG. 1C can be used in a partial load condition where the load is below the full load for the compressor 100, and less than the load where the capacity control valve is in a high flow position such as in FIG. 1B. In the low flow position shown in FIG. 1C, the capacity control valve 116 is extended axially such that it extends through side stream injection port 114, extending further than the high flow position shown in FIG. 1B. The leading side 130 of the capacity control valve 116 deflects the interstage flow in compressor 100 due to the greater projection of the capacity control valve 116, further reducing the size of the passage for interstage flow. The capacity control valve 116 restricts flow through the side stream injection port to a greater extent than when in the high flow position shown in FIG. 1B and described above, with curved surface 134 further reducing the orifice size by being even closer to the leading end 124 of the side stream injection port 114. The trailing side 132 of the capacity control valve 116 continues to be in contact with the trailing end 126 of the side stream injection port 114, and all flow through side stream injection port 114 passes between the leading end 124 of side stream injection port 114 and the leading side 130 of capacity control valve 116. Optionally, inlet guide vane 102 can be rotated to further obstruct flow to the first stage impeller 104 of compressor 100 compared to its position in the high flow position shown in FIG. 1B.

Figure 1D:
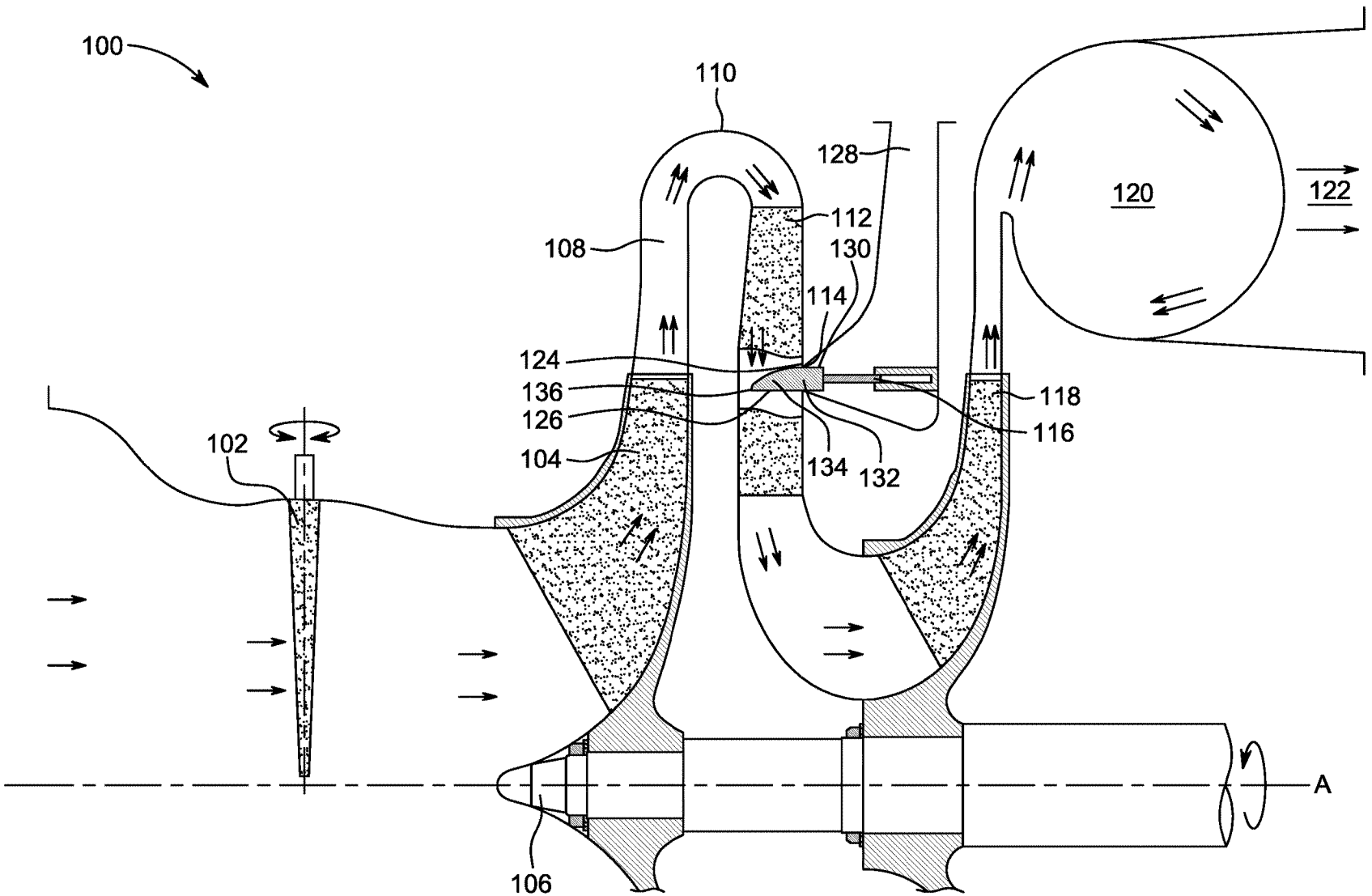
FIG. 1D shows a sectional view of the compressor shown in FIG. 1A when the capacity control valve is in a closed position.

FIG. 1D shows a sectional view of the compressor shown in FIG. 1A when the capacity control valve is in a closed position. The closed position shown in FIG. 1D can be used when the compressor 100 is in a partial-load condition at or near a minimum load for the compressor. In the closed position, capacity control valve 116 partially or completely obstructs side stream injection port 114, from leading end 124 to trailing end 126. It is appreciated that due to manufacturing tolerances, wear, etc. that there may be some leakage even when the capacity control valve 116 is configured to completely obstruct the side stream and is in the closed position. In an embodiment, capacity control valve 116 is sized such that it does not contact side stream injection port 114 and allows some flow to continue through side stream injection port 114 even in the fully extended closed position. The extension of the capacity control valve 116 into the interstage flow through compressor 100 is at a maximum, reducing the size of the orifice through which the interstage flow passes from return bend 110 towards second stage impeller 118. Accordingly, this position imparts the greatest additional velocity to the interstage flow, while prohibiting the side stream flow from joining the interstage flow. Optionally, inlet guide vane 102 can be rotated to further obstruct flow to the first stage impeller 104 of compressor 100, for example by pacing the inlet guide vane 102 in a minimum-flow position.

Figure 2A:
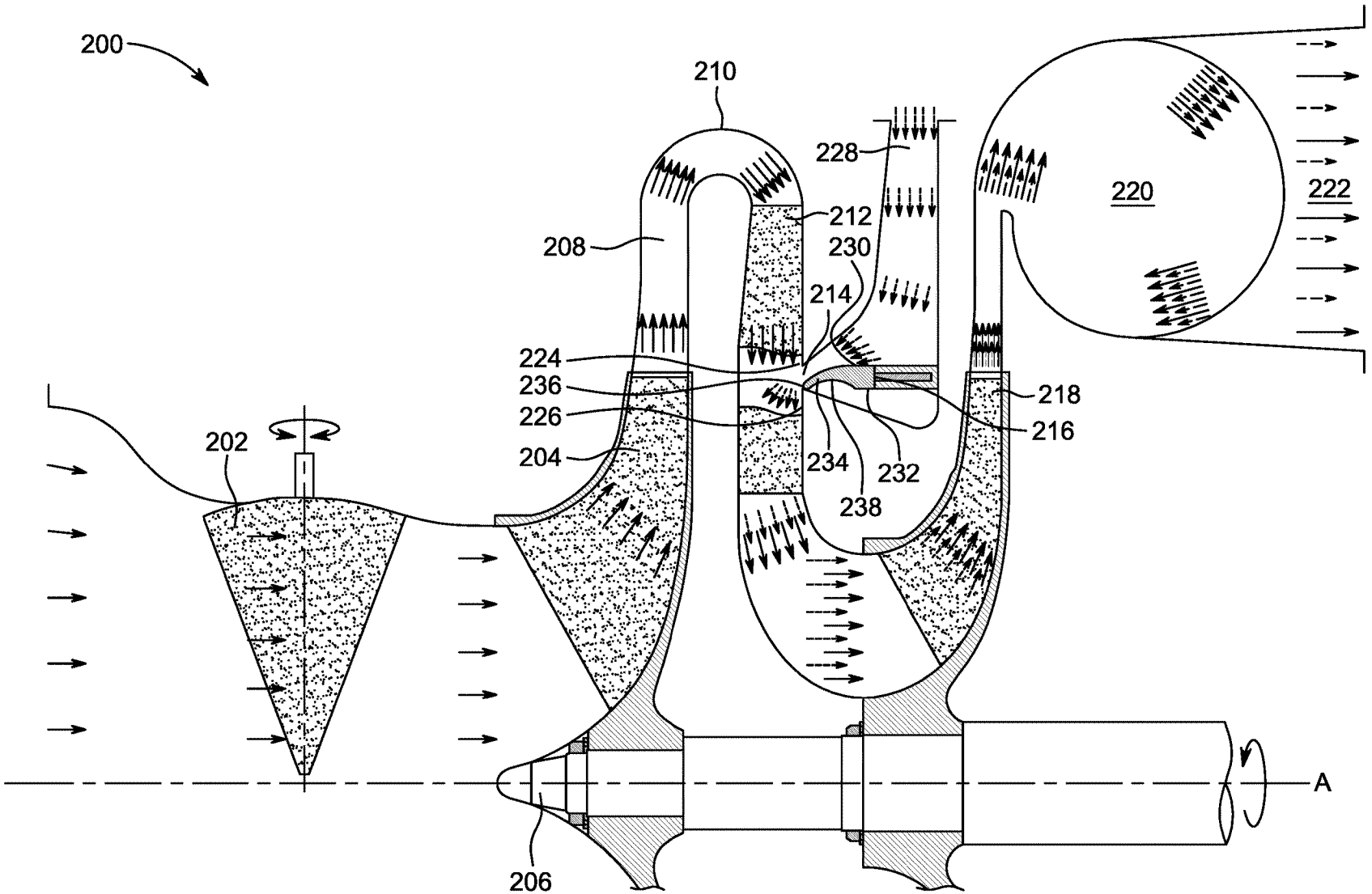
FIG. 2A shows a sectional view of a compressor according to an embodiment when a capacity control valve is in a fully open position.

FIG. 2A shows a sectional view of a compressor 200 according to an embodiment when a capacity control valve is in a fully open position. Compressor 200 can have a cylindrical structure such that the sectional view shown in FIGS. 2A-2D be repeated or continuous through 360° of rotation about axis A of the compressor 200.

Compressor 200 is a multi-stage centrifugal compressor. Compressor 200 includes an inlet guide vane 202 where a core flow of fluid to be compressed is received. Compressor 200 includes a first stage impeller 204 driven by rotation of shaft 206, a diffuser 208 downstream of the first stage impeller 204, and a return bend 210 downstream of the diffuser 208. Compressor 200 further includes one or more deswirl vanes 212 downstream of the return bend 210. Compressor 200 includes a side stream injection port 214 and a capacity control valve 216. Compressor 200 includes a second stage impeller 218 downstream of the deswirl vanes 212 and the side stream injection port 214, with a volute scroll 220 and a discharge conic 222 downstream of the second stage impeller 218.

While compressor 200 is shown in FIGS. 2A-2D as a two-stage compressor, compressors according to embodiments can include any number of stages, with the side stream injection port 214 and the capacity control valve 216 are provided in an interstage flow path between any two stages of the compressor. For example, compressor 200 can be a three-stage compressor, with the side stream injection port 214 and capacity control valve 216 disposed between the exhaust of the second stage and the intake of the third stage, or the like.

Compressor 200 can include one or more inlet guide vane 202 to control flow of working fluid into the compressor 200. The inlet guide vanes 202 can be substantially similar to the inlet guide vanes 102 described above and shown in FIGS. 1A-1D. The one or more inlet guide vanes 202 can be configured to obstruct or permit flow of working fluid into the compressor 200. In an embodiment, each of the inlet guide vanes 202 can be a rotating vane, for example, each rotating vane forming a section of a circle such that when all rotating vanes are in a closed position, the inlet guide vanes 202 obstruct an inlet of the compressor 200. The one or more inlet guide vanes 202 can be movable between a fully open position and the closed position. In the fully open position the effect of the inlet guide vanes 202 on flow into compressor 200 can be minimized, for example by positioning the inlet guide vanes 202 such that the plane of each vane is substantially parallel to the direction of flow of working fluid into the inlet of compressor 200. In an embodiment, each or all of the one or more inlet guide vanes 202 can be varied continuously from the fully open position to the closed position.

Compressor 200 includes a first stage impeller 204. The first stage impeller 204 is driven by shaft 206. Shaft 206 is rotated by, for example, a prime mover such as a motor. The first stage impellers 204 are configured to draw in the working fluid that passes the one or more inlet guide vanes 202 when rotated, and to expel the working fluid towards diffuser 208.

Diffuser 208 receives the fluid discharged from first stage impellers 204 and directs the flow of the fluid towards return bend 210. Return bend 210 changes the direction of the flow of the fluid such that it travels through the deswirl vanes 212 towards the second stage impeller 218.

One or more deswirl vanes 212 are vanes extending from the return bend 210 towards the second stage impeller 218. The deswirl vanes 212 are shaped to straighten the flow of the fluid as the flow passes towards the second stage impeller 218. The deswirl vanes 212 can include notches configured to receive at least a portion of the capacity control valve 216.

Side stream injection port 214 is a port configured to allow a side stream to be introduced into the interstage flow of fluid through compressor 200. The side stream injection port 214 includes a leading end 224 and a trailing end 226, with the leading end 224 towards the return bend 210 and the trailing end 226 towards the second stage impeller 218. Side stream injection port 214 fluidly connects a side stream flow channel 228 with the interstage flow. The side stream flow channel 228 can receive a side stream of fluid from within a fluid circuit including the compressor 200. The source of the side stream of fluid received by side stream flow channel 228 can be from one or more of a condenser, an economizer, an intercooler, a heat exchanger, or any other suitable source of fluid that is at an intermediate pressure, between the suction pressure and the discharge pressure of the compressor 200. The side stream injection port 214 can be a ring shape surrounding an intake of the second stage impeller 218. The side stream injection port 214 can be provided between the return bend 210 and the second stage impeller 218.

Capacity control valve 216 is a valve that configured regulate the flow through the side stream injection port 214. Capacity control valve 216 is configured to be extended axially through the side stream injection port 214 such that it extends substantially perpendicular to a direction of flow of the interstage flow from deswirl vane 212 towards the second stage impeller 218. Capacity control valve 216 is configured to be able to prohibit flow through side stream injection port 214 in a closed position, for example by including a portion having a thickness corresponding to the width of the side stream injection port 214 from leading end 224 to trailing end 226. In an embodiment, capacity control valve 216 is controlled in conjunction with inlet guide vanes 202. In an embodiment, capacity control valve 216 is controlled independently of inlet guide vanes 202.

Capacity control valve 216 includes a leading side 230 facing towards the return bend 210 and a trailing side 232 facing towards an inlet into second stage impeller 218. Leading side 230 includes curved surface 234 extending towards a tip 236 of the capacity control valve 116. The curved surface 234 can cause the distance between capacity control valve 216 and leading end 224 of side stream injection port 214 to be varied as capacity control valve 216 is axially extended or retracted.

Trailing side 232 includes one or more passages 238 configured to allow the side stream flow from side stream flow channel 228 to pass through the side stream injection port 214 and be introduced into the interstage flow on the trailing side 232 of the capacity control valve 216. In an embodiment, passage 238 includes one or more channels having openings on the trailing side 232 of the capacity control valve 216. In an embodiment, passage 238 is a cutout or scalloping formed in the trailing side 232, such that in some positions of capacity control valve 216, a gap exists between the trailing side 232 and the trailing end 224 of the side stream injection port 214.

In the fully open position of the capacity control valve 216, side stream flow passes from the side stream flow channel 228 through side stream injection port 214, between the leading end 224 of the side stream injection port 214 and the leading side 230 of the capacity control valve 216. Tip 236 of the capacity control valve 216 is located within the side stream injection port 214 or retracted into the side stream flow channel 228, and capacity control valve 216 does not substantially affect the interstage flow passing from return bend 210 to second stage impeller 218. Optionally, in the fully open position shown in FIG. 2A, inlet guide vane 202 can be in an open position where it provides little to no resistance to flow into the first stage impeller 204. The fully open position shown in FIG. 2A can be used, for example, when compressor 200 is being operated at or near full load capacity. In the embodiment shown in FIG. 2, when in the fully open position shown in FIG. 2A, some or all of the side stream flow passing through side stream injection port 214 can pass over the leading side 230 of capacity control valve 216.

Second stage impeller 218 is used to achieve the second stage of compression. Second stage impeller 218 draws in the combined interstage and side stream flows and expels the fluid towards volute scroll 220. Second stage impeller 218 can be rotated by shaft 206, which is also used to rotate first stage impeller 204. Fluid at the volute scroll 220 can then be discharged from compressor 200 at discharge conic 222.

In an embodiment, the side stream provided through side stream injection port 214 can be received from an economizer, such as the economizer 314 shown in FIG. 3B and described below. The economizer can be a flash-tank economizer, where flash or bypass gas rises and can be directed to the side stream flow channel 228. The gas from the economizer being directed to the side stream flow channel 228 can reduce or eliminate the presence of gas in the liquid being passed to an evaporator of the HVACR system including compressor 200. This can in turn improve the absorption of energy at the evaporator without further subcooling by providing more saturated liquid working fluid. In the full load cycle corresponding to the fully open position of capacity control valve 216, the pressure at the side stream injection port 214 can allow the entrained vapor to be substantially removed from the working fluid in the economizer.

Figure 2B:
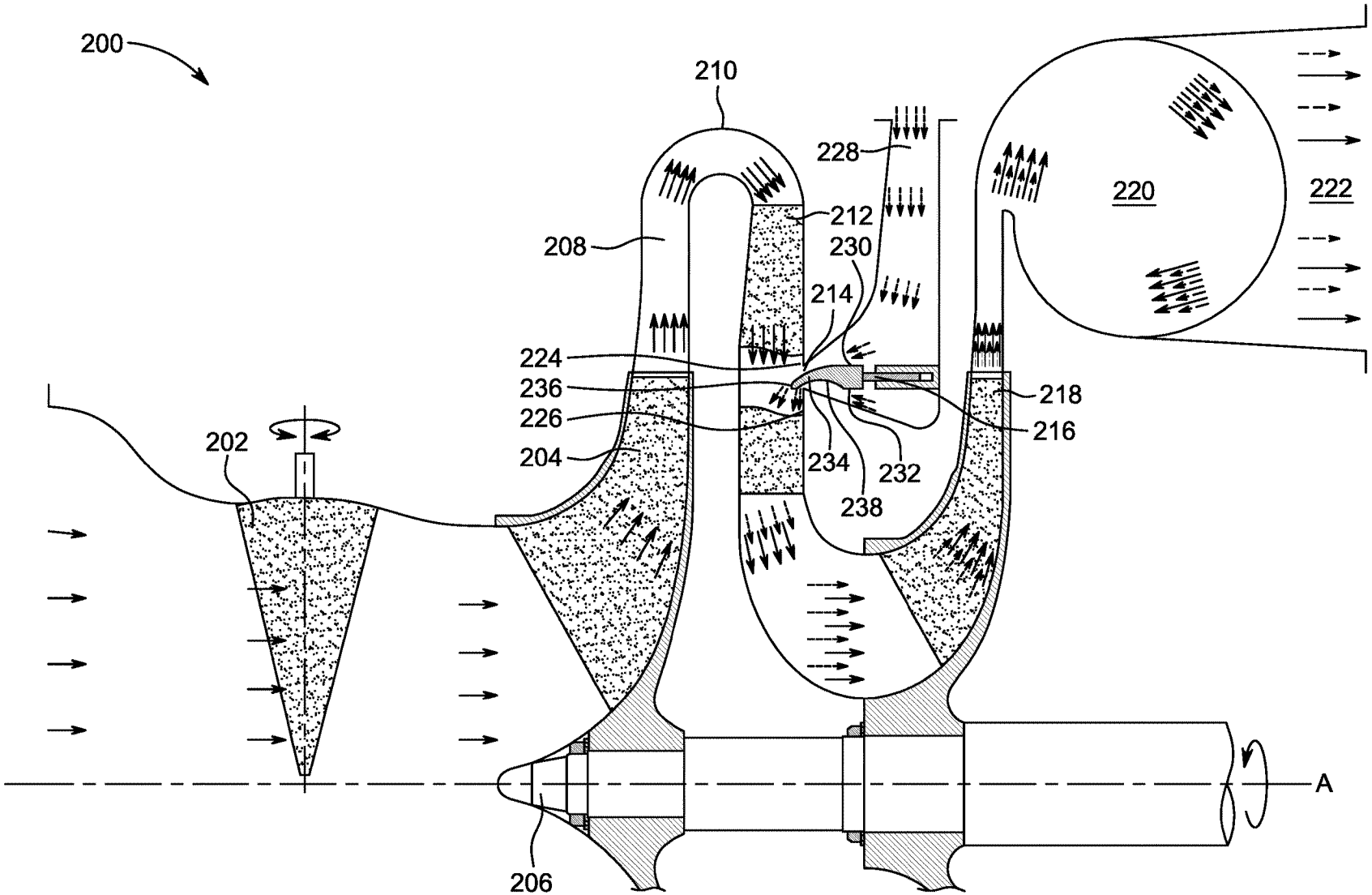
FIG. 2B shows a sectional view of the compressor shown in FIG. 2A when the capacity control valve is in a high flow position.

FIG. 2B shows a sectional view of the compressor shown in FIG. 2A when the capacity control valve 216 is in a high flow position. The high flow position shown in FIG. 2B can be used in a partial load condition where the load is relatively close to full load for the compressor 200. In the high flow position shown in FIG. 2B, capacity control valve 216 is extended such that tip 236 projects into the path for interstage flow from return bend 210 to the second impeller 218, partially obstructing the path for the interstage flow. In the high flow position of the embodiment shown in FIG. 2B, a first gap exists between the leading end 224 of the side stream injection port and the leading side 230 of the capacity control valve 216, and a second gap exists at passage 238 between the trailing side 232 of the capacity control valve 216 and the trailing end 226 of the side stream injection port 214. Each of the first and second gaps allow some of the side stream flow to join the interstage flow. The portion passing through the second gap experiences less of the pressure exerted by the interstage flow due to its introduction on the trailing side 232 of the capacity control valve 216. Optionally, in the high flow position shown in FIG. 2B, inlet guide vane 202 can be in a high flow position where the inlet guide vane 202 provides increased resistance to flow into the first stage impeller 204 compared to the fully open position shown in FIG. 2A, but less resistance to flow than the low flow or closed positions shown in FIGS. 2C and 2D, respectively. In the high-flow position shown in FIG. 2B, flow through side stream injection port 214 can include both flow over the leading side 230 and past the trailing side 232 of the capacity control valve.

Figure 2C:
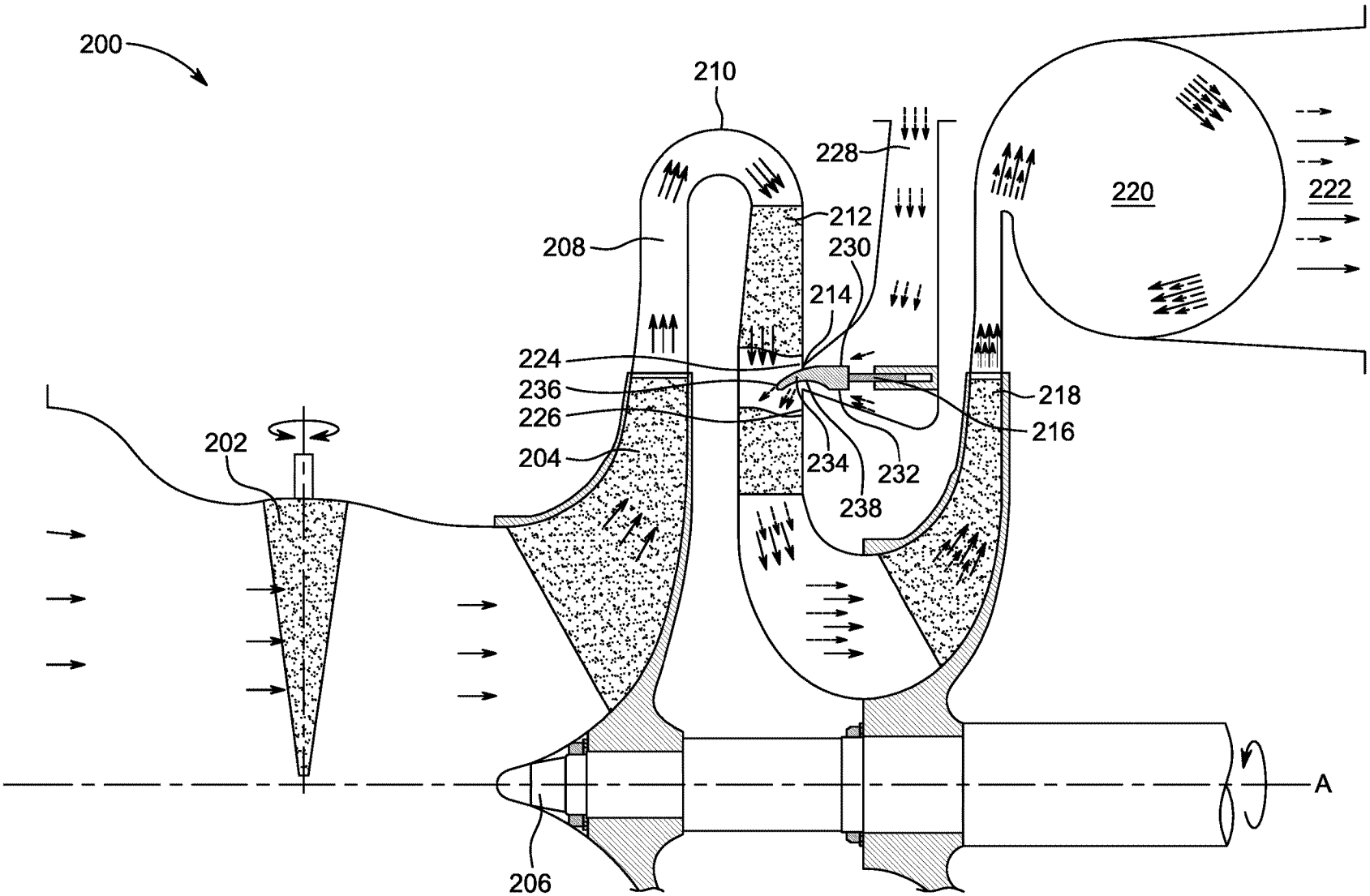
FIG. 2C shows a sectional view of the compressor shown in FIG. 2A when the capacity control valve is in a low flow position.

FIG. 2C shows a sectional view of the compressor shown in FIG. 2A when the capacity control valve 216 is in a low flow position. The low flow position shown in FIG. 2C can be used in a partial load condition where the load is below the full load for the compressor 200, and less than the load where the capacity control valve is in a high flow position such as in FIG. 2B. In the low flow position shown in FIG. 2C, capacity control valve 216 is extended further into the interstage flow from return bend 210 to second impeller 218. The capacity control valve 216 thus provides even greater resistance to the interstage flow when compared to the high flow position shown in FIG. 2B. In the low flow position of the embodiment shown in FIG. 2C, a first gap exists between the leading end 224 of the side stream injection port and the leading side 230 of the capacity control valve 216, and a second gap exists at passage 238 between the trailing side 232 of the capacity control valve 216 and the trailing end 226 of the side stream injection port 214. Compared to the first and second gaps shown of the high flow position shown in FIG. 2B, in the low flow position of FIG. 2C, the second gap is relatively larger compared to the first, and a greater proportion of the side stream flow passes through the second gap to join the interstage flow relative to the amount of the side stream flow passing through the first gap. Optionally, in the low flow position shown in FIG. 2C, inlet guide vane 202 can be in a low flow position where the inlet guide vane 202 provides increased resistance to flow into the first stage impeller 204 compared to the high flow position shown in FIG. 2B, but less resistance to flow than the closed positions shown in FIG. 2D. In the low-flow position shown in FIG. 2B, flow through side stream injection port 214 can primarily or entirely be past the trailing side 232 of the capacity control valve. The shape of the leading side 230 and of passage 238 can each or both be selected to control the relative amount of flow being introduced on either the leading side 230 or trailing side 232 of the capacity control valve 216, and how those relative amounts vary with the position of capacity control valve 216 from the fully open position through the closed position as shown in FIGS. 2A-2D.

In an embodiment, side stream flow channel 228 can receive the side stream flow from an economizer, such as economizer 314 shown in FIG. 3B and described below. Providing passage 238 in capacity control valve 216 can allow capacity control valve 216 to not only control the quantity of flow being introduced, but the particular point at which the side stream is introduced in side stream injection port 214, and the pressure at the point of introduction. Controlling the position of the point of introduction of side stream flow can provide control over the relationship between core flow and side stream flow in the compressor. Control of the point of introduction can improve economizer effectiveness across different load conditions. The low flow position shown in FIG. 2C can be used when compressor 200 is operated at part load. When the compressor 200 is operated at part load, the static pressure at the side stream injection port 214, particularly between leading end 222 of the side stream injection port 214 and the leading side 232 of the capacity control valve 216, can be relatively elevated. The pressure within the economizer is a function of the static pressure at the injection location in compressor 200, in addition to pipe losses and fixed orifice pressure drops for the system. The elevated pressure at side stream injection port 214 can therefore lead to an elevated pressure at the economizer, reducing effectiveness in removing flash or bypass gas from the fluid contained within. Passage 238, by being on an opposite side of the capacity control valve 216 from leading side 232 that is facing the interstage flow within compressor 200, is subject to a reduced pressure in comparison to the pressure on the leading side 232, or the static pressure at the side stream injection port 114 in the embodiment shown in FIG. 1C. The reduced pressure at such an injection point can correspondingly lower the pressure within the economizer as described above, improving the release of flash or bypass gas from liquid in the economizer and its removal from the stream of working fluid passing to the evaporator. This improves the heat transfer at the evaporator and can also reduce recompression losses in the system including compressor 200 having capacity control valve 216 including passages 238.

Figure 2D:
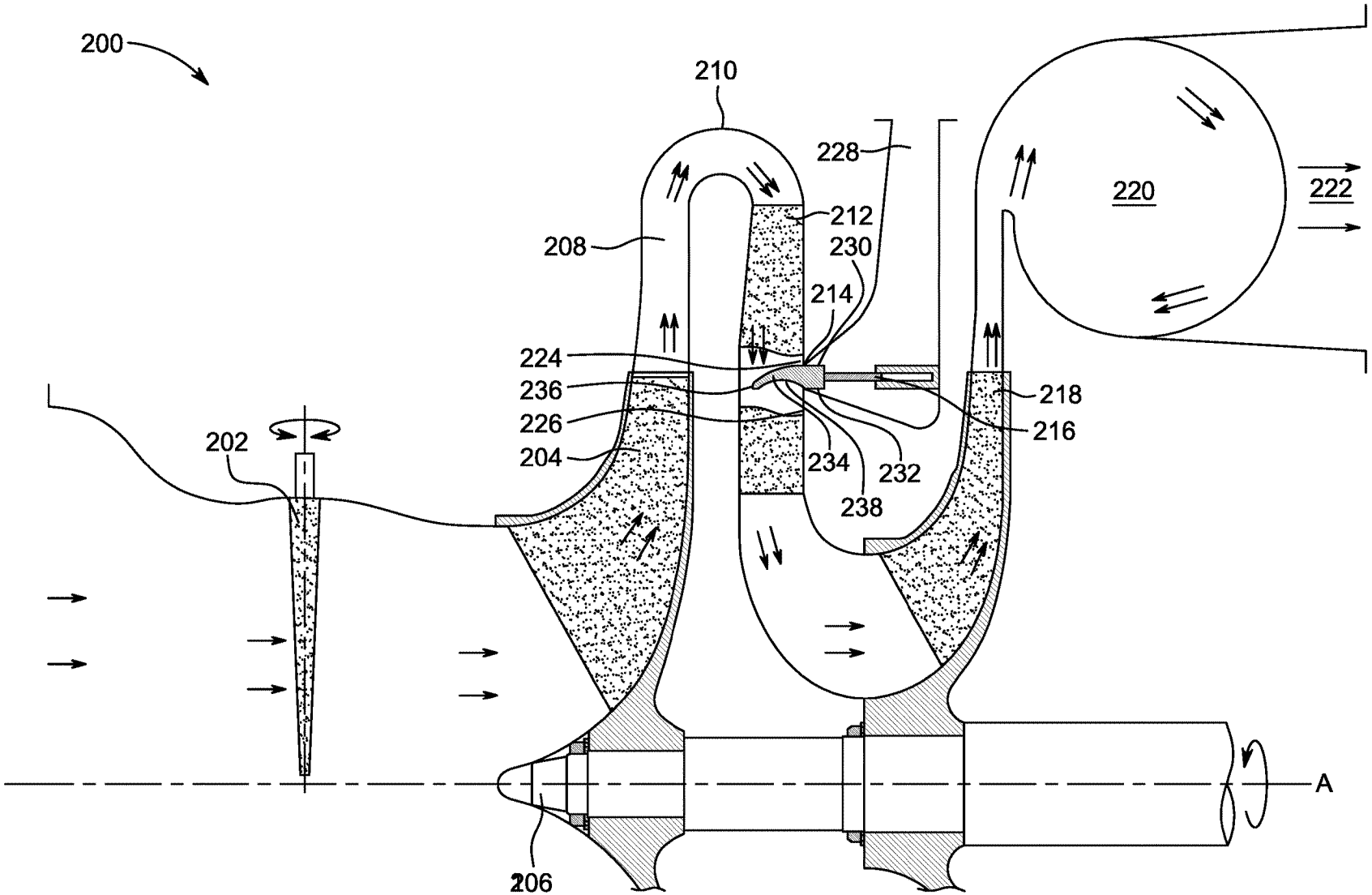
FIG. 2D shows a sectional view of the compressor shown in FIG. 2A when the capacity control valve is in a closed position.

FIG. 2D shows a sectional view of the compressor shown in FIG. 2A when the capacity control valve 216 is in a closed position. The closed position shown in FIG. 2D can be used when the compressor 200 is in a partial-load condition at or near a minimum load for the compressor. In the closed position, capacity control valve 216 partially or completely obstructs side stream injection port 214, from leading end 224 to trailing end 226. It is appreciated that due to manufacturing tolerances, etc., there may be some possible leakage even when capacity control valve 216 is in the closed position. In an embodiment, capacity control valve 216 may be sized such that it does not contact side stream injection port 214, and allows some flow through the gap between the side stream injection port 214 and the capacity control valve 216. Any features of capacity control valve 216 configured to allow the introduction of the side stream flow on the trailing side 232 of the capacity control valve 216 such as passage 238 can be configured such that they do not permit such flow when capacity control valve 216 in the closed position. For example, as shown in FIG. 2D, a scalloped portion on the trailing side 232 forming passage 238 in this embodiment is sized and positioned such the trailing side 232 contacts the trailing end 226 of side stream injection port 214 when the capacity control valve 216 is extended into the closed position. The extension of the capacity control valve 216 into the interstage flow through compressor 200 is at a maximum, reducing the size of the orifice through which the interstage flow passes from return bend 210 towards second stage impeller 218. Accordingly, this position imparts the greatest additional velocity to the interstage flow, while prohibiting the side stream flow from joining the interstage flow. Optionally, inlet guide vane 202 can be rotated to further obstruct flow to the first stage impeller 204 of compressor 200, for example by pacing the inlet guide vane 202 in a minimum-flow position.

Figure 3A:
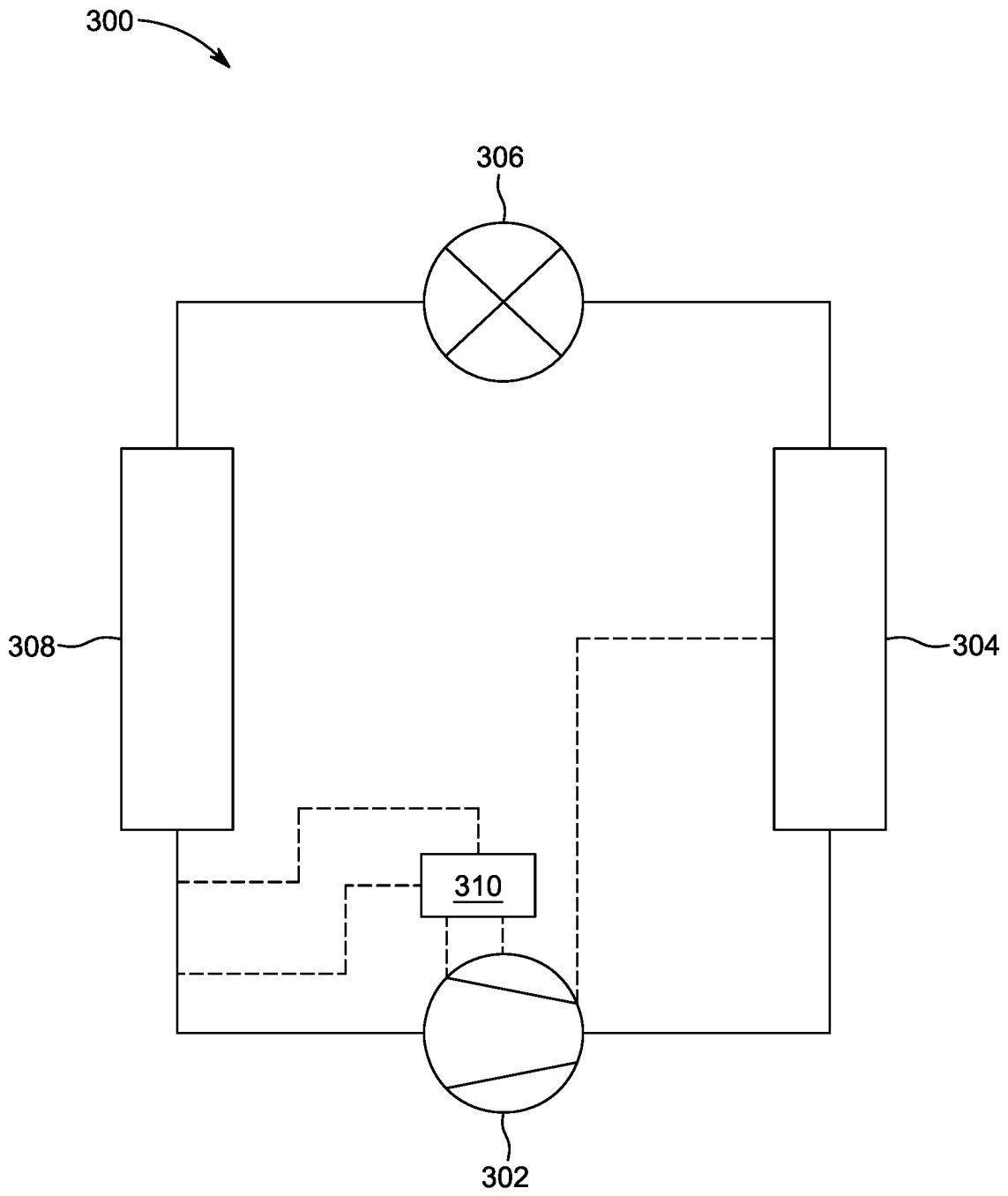
FIG. 3A shows a heating, ventilation, air conditioning and refrigeration (HVACR) circuit according to an embodiment.

FIG. 3A shows a heating, ventilation, air conditioning and refrigeration (HVACR) circuit according to an embodiment. HVACR circuit 300 includes compressor 302, condenser 304, expander 306, and evaporator 308.

Compressor 302 is a centrifugal compressor, for example compressor 100 shown in FIGS. 1A-1D or compressor 200 shown in FIGS. 2A-2D and described above.

Condenser 304 receives working fluid from compressor 302 and allows the working fluid to reject heat, for example to air or another heat exchange medium. In an embodiment, a fluid line from the condenser 304 can convey some of the working fluid of HVACR circuit 300 back to compressor 302, as the side stream flow provided to the side stream flow injection port of the compressor 302, such as side stream injection ports 114 or 214 described above and shown in FIGS. 1A-2D. Condensed working fluid from condenser 304 can then pass to expander 306.

Expander 306 expands the working fluid passing through as the fluid passes through HVACR circuit 300. Expander 306 can be any suitable expander for the working fluid within the HVACR circuit 300, such as, for example, an expansion valve, one or more expansion orifices, or any other suitable expansion device for use in an HVACR circuit.

Evaporator 308 is a heat exchanger where the working fluid of HVACR circuit 300 absorbs heat, for example from an ambient environment or a fluid to be cooled such as water in a water chiller HVACR system. The evaporator 308 can be, for example, an indoor coil of an air conditioner or a heat exchanger configured to cool water used in an HVACR system including the HVACR circuit 300.

HVACR circuit 300 can further include an intercooler 310. Intercooler 310 is a heat exchanger where working fluid from the HVACR circuit exchanges heat with the interstage flow within compressor 302. The working fluid that exchanges heat with the interstage flow in intercooler 310 can be sourced from, for example, evaporator 308, between expander 306 and evaporator 308, or between the evaporator 308 and the compressor 302. Some or all of the working fluid that exchanges heat with the interstage flow can then be reintroduced into HVACR circuit 300 downstream of where the working fluid is sourced. In an embodiment, at least some of the working fluid from intercooler 310 can be directed to a side stream flow channel of compressor 302 instead of returning to the ordinary flow path through HVACR circuit 300. The side stream flow channel can be, for example, side stream flow channel 128 or side stream flow channel 228 of the compressors 100 and 200 described above and shown in FIGS. 1A-1D and 2A-2D.

Figure 3B:
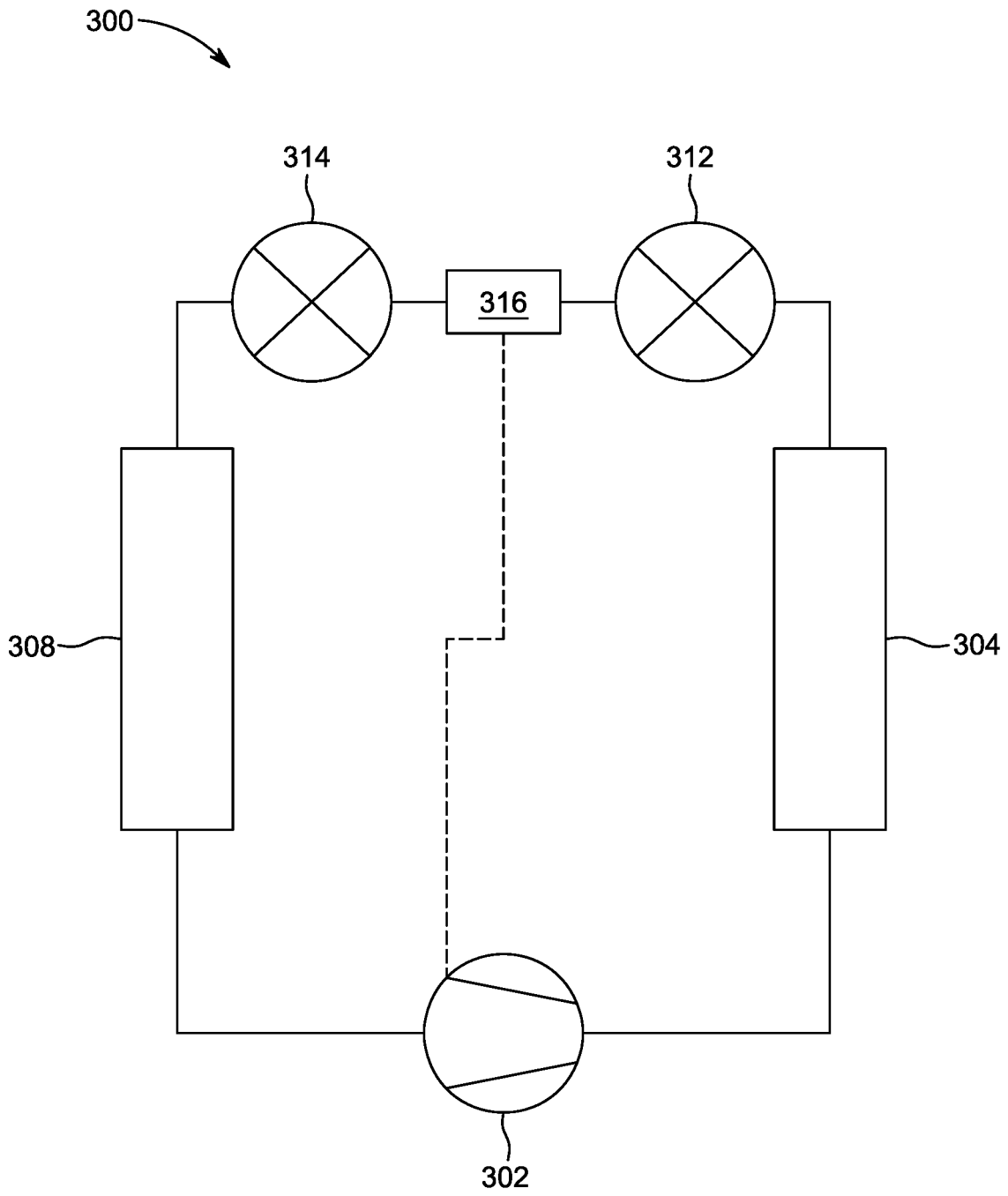
FIG. 3B shows an economized HVACR circuit 320 according to an embodiment.

FIG. 3B shows an economized HVACR circuit 320 according to an embodiment. In FIG. 3B, compressor 302, condenser 304 and evaporator 308 are included as in HVACR circuit 300 described above and shown in FIG. 3A, with compressor 302 being a multi-stage compressor in this embodiment. HVACR circuit 320 includes a first expander 312 and a second expander 314. Each of first expander 312 and second expander 314 can be any suitable expander for the working fluid within the HVACR circuit 320 such as, for example, an expansion valve, one or more expansion orifices, or any other suitable expansion device for use in an HVACR circuit. Economizer 314 can be disposed between first and second expanders 312, 314, such that working fluid of HVACR circuit 320 is at an intermediate pressure at the economizer 314. The economizer 314 can be used as a source for the side stream introduced into compressor 302, for example through a side stream flow channel such as side stream flow channel 128 or side stream flow channel 228 as described above and shown in FIGS. 1A-1D and 2A-2D.

Figure 4:
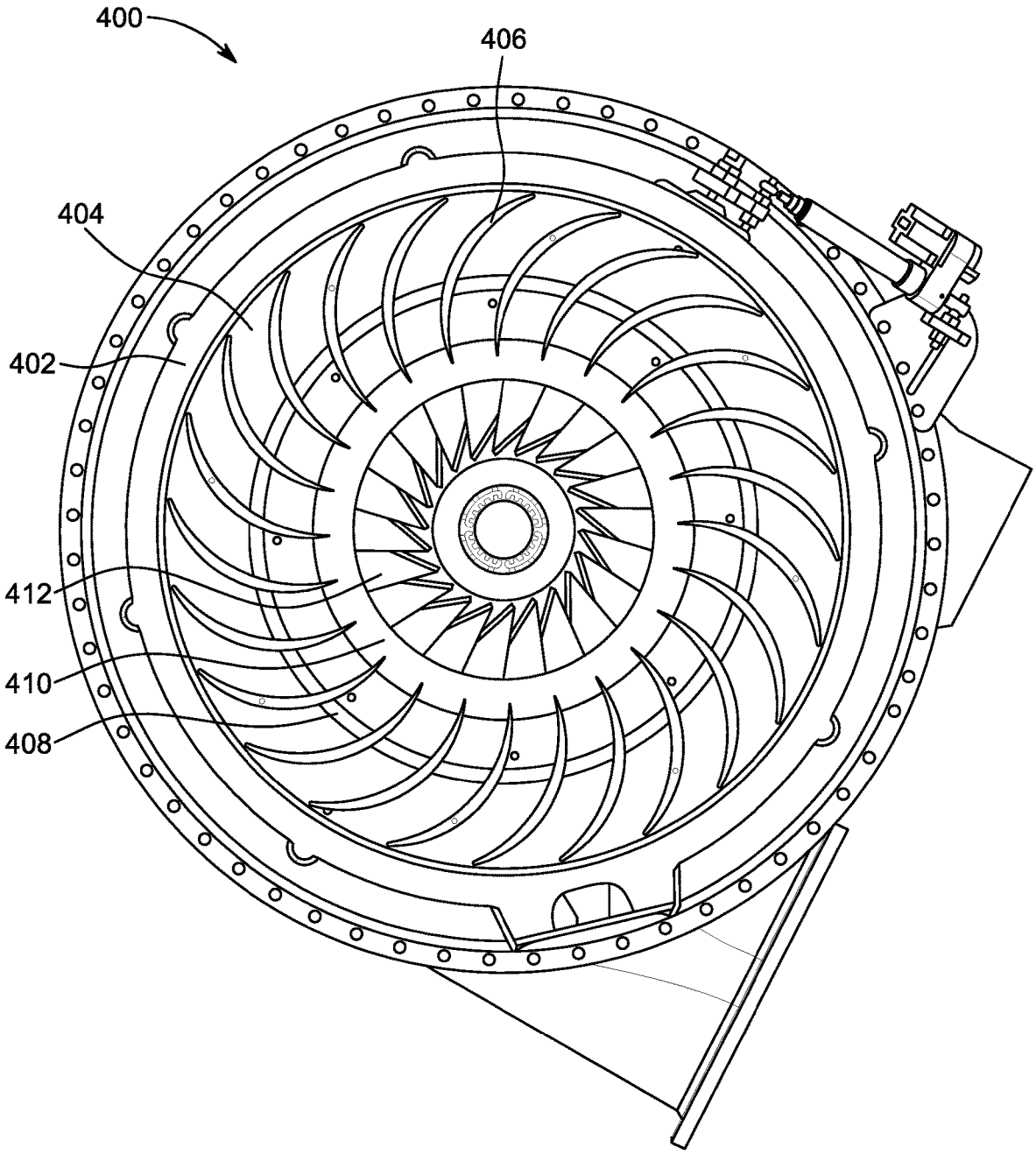
FIG. 4 shows a sectional view of a centrifugal compressor according to an embodiment along an interstage flow path.

FIG. 4 shows a sectional view of a centrifugal compressor according to an embodiment along an interstage flow path. Centrifugal compressor 400 includes compressor housing 402. Compressor housing 402 in part defines an interstage flow path 404. The interstage flow path includes deswirl vanes 406 radially distributed around the interstage flow path 404. Capacity control valve ring 408 extends into interstage flow path 404, upstream of following stage inlet 410. Capacity control valve ring can 408 be, for example, capacity control valve 116 or capacity control valve 216 as described above and shown in FIGS. 1A-1D and 2A-2D. Capacity control valve ring 408 can be a single continuous ring or composed of a plurality of ring segments that combine to provide the ring shape. Following stage inlet 410 receives flow passing the capacity control valve ring 408 and allows the flow to enter into the following stage impeller 412.

Figure 5:
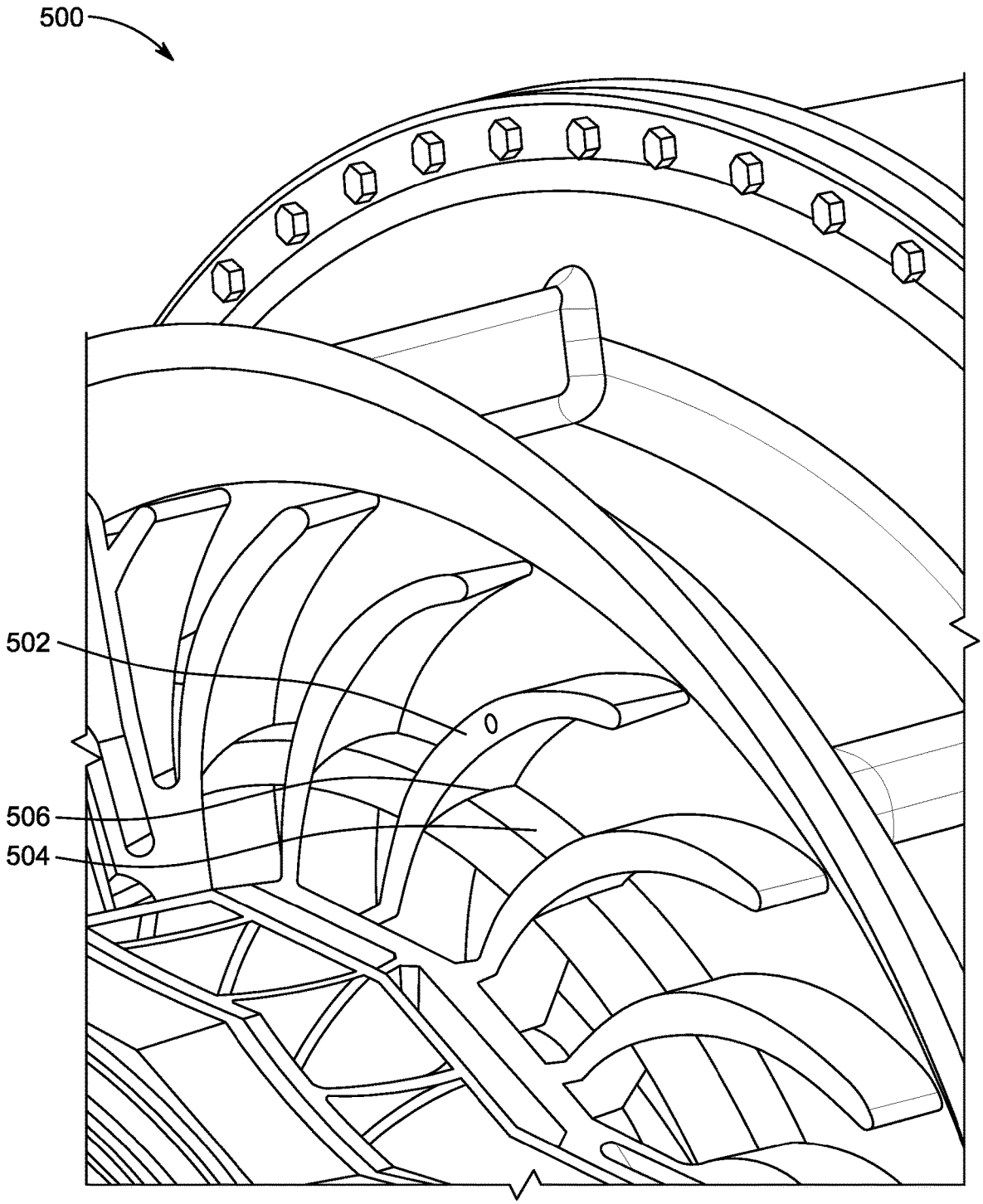
FIG. 5 shows a sectional view of a portion of a centrifugal compressor according to an embodiment.

FIG. 5 shows a sectional view of a portion of a centrifugal compressor according to an embodiment. In the view of centrifugal compressor 500, the interaction between the deswirl vanes 502 and the capacity control valve ring 504. Deswirl vanes 502 can be any of the deswirl vanes shown in FIG. 1A-1D, 2A-2D, or 4. Capacity control valve ring 504 can be any of the capacity control valves shown in FIG. 1A-1D, 2A-2D, or 4. Capacity control valve ring includes notches 506, each of notches 506 configured to accommodate one of the deswirl vanes 502 such that the capacity control valve ring 504 can be extended into a flow path including the deswirl vanes 502 without mechanically interfering with the deswirl vanes 502. In an embodiment, notches corresponding to notches 506 can instead be included on each of the deswirl vanes 502 such that the deswirl vanes 502 do not contact the capacity control valve ring 504 as it is extended. In an embodiment, notches 506 are provided along with corresponding notches on the deswirl vanes 502. In this embodiment, the notches 506 can have a depth that is less than an entire height of the area where capacity control valve ring 504 could contact deswirl vanes 502, and the notches in the deswirl vanes have a depth such that they accommodate any portion of capacity control valve ring 504 that would otherwise contact the deswirl vanes 502 in the absence of said notches.

Figure 6:
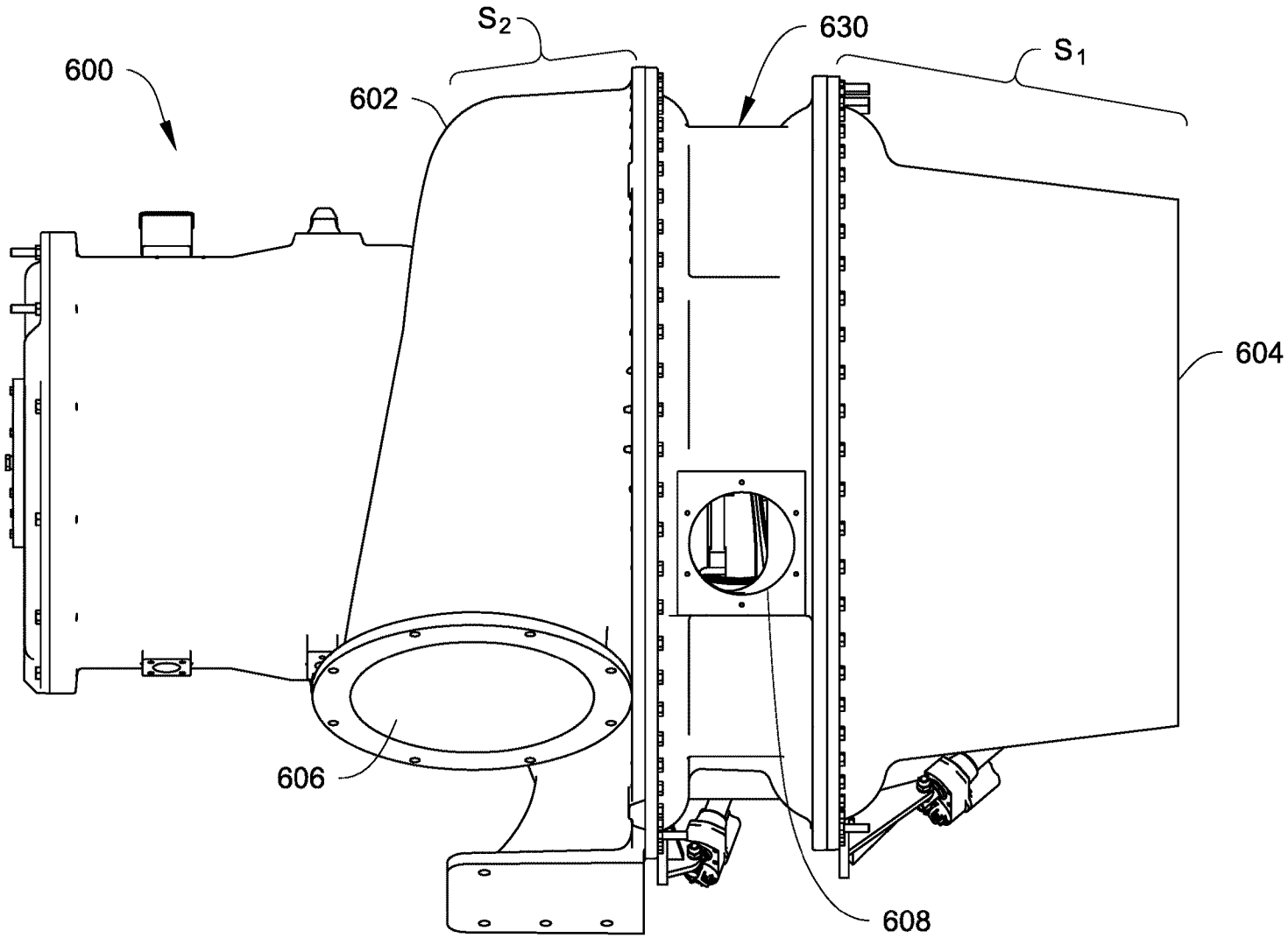
FIG. 6 is a side perspective view of an embodiment of a centrifugal compressor.
Figure 7:
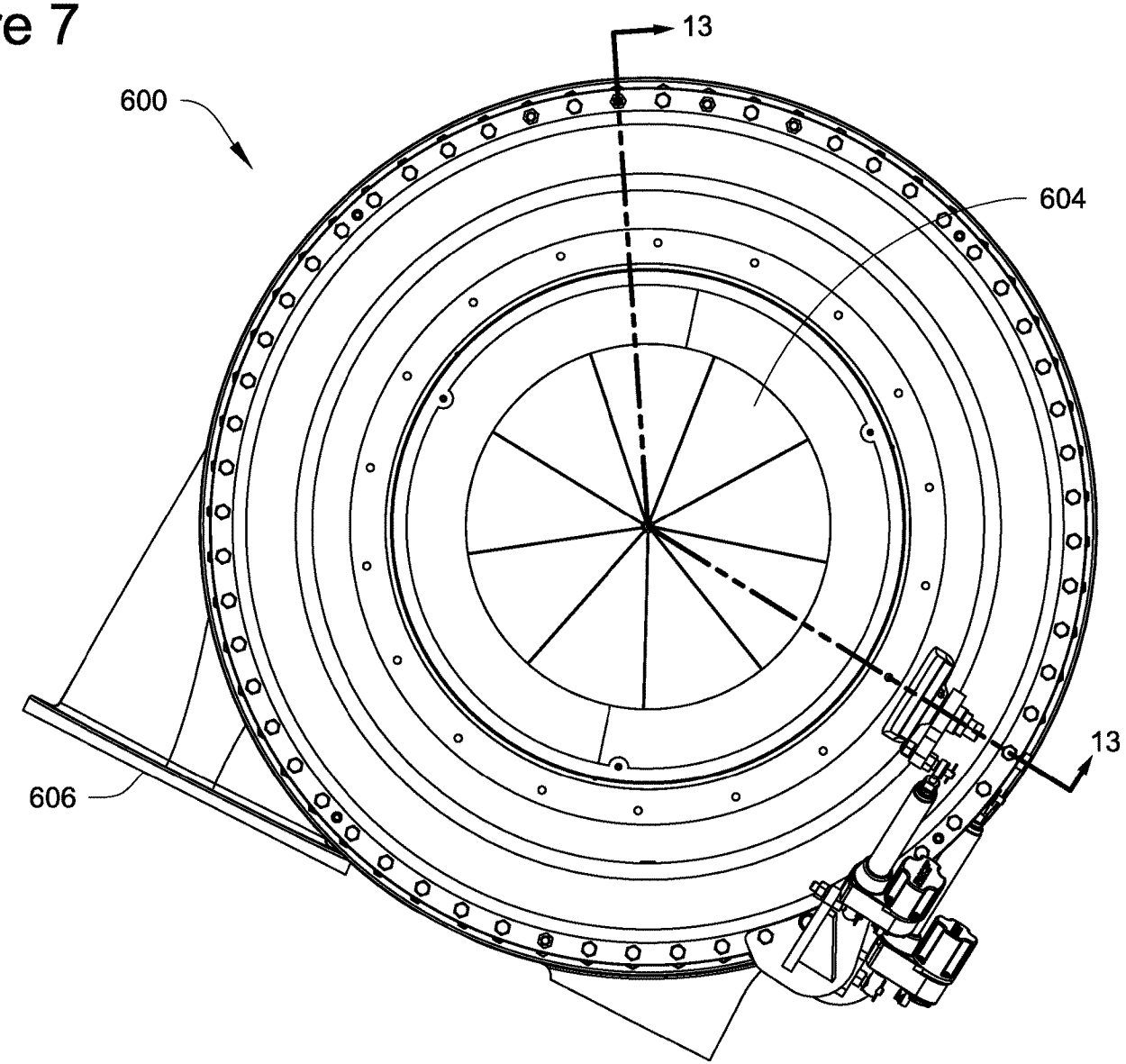
FIG. 7 is a front view of the centrifugal compressor of FIG. 6 according to an embodiment.

FIG. 6 is a side perspective view of an embodiment of a centrifugal compressor 600. FIG. 7 is a front view of the centrifugal compressor 600. In an embodiment, the centrifugal compressor 600 is the compressor 302 in the HVACR circuit 302 in FIG. 3A or FIG. 3B. The compressor 600 includes a housing 602 having a suction inlet 604, a discharge outlet 606, and an intermediate injection inlet 608. Working fluid enters the housing 600 through the suction inlet 604, is compressed by the compressor 600, and is discharged as compressed working fluid from the discharge outlet 606.

The compressor 600 includes a first stage $S_1$, a second stage $S_2$, and an interstage throttle 630. The working fluid is compressed in the first stage $S_1$ (e.g., to a first pressure $P_1$), flows from the first stage to the second stage $S_2$, and is then further compressed to a higher pressure (e.g., second pressure $P_2$) in the second stage $S_1$. The intermediate injection inlet 608 is configured to receive a side stream of intermediate pressure working fluid (e.g., at an intermediate pressure that is between the first pressure $P_1$ and the second pressure $P_2$). The intermediate injection inlet 608 can be, for example, the side stream flow channel 128 or the side stream flow channel 228 as described above and shown in FIGS. 1A-1D and 2A-2D. The compressed working fluid discharged from the first stage $S_1$ flows from the first stage $S_1$ to the second stage $S_2$ through the interstage throttle 630. For example, the intermediate injection inlet 608 connects to a side stream injection port (e.g., side stream injection port 114, side stream injection port 214, or the like) disposed between the first stage $S_1$ and the second stage $S_2$. The intermediate pressure working fluid mixes with the stream of compressed interstage fluid flowing from the first stage $S_1$ to the second stage $S_2$, and the mixed flow of compressed interstage fluid and intermediate pressure fluid flow into the second stage $S_2$. The interstage throttle 630 is configured to control a flowrate of the interstage fluid from the first stage $S_1$ to the second stage $S_2$ and a flowrate of the intermediate pressure fluid through the intermediate injection inlet 608 and into the second stage $S_2$.

Figure 8:
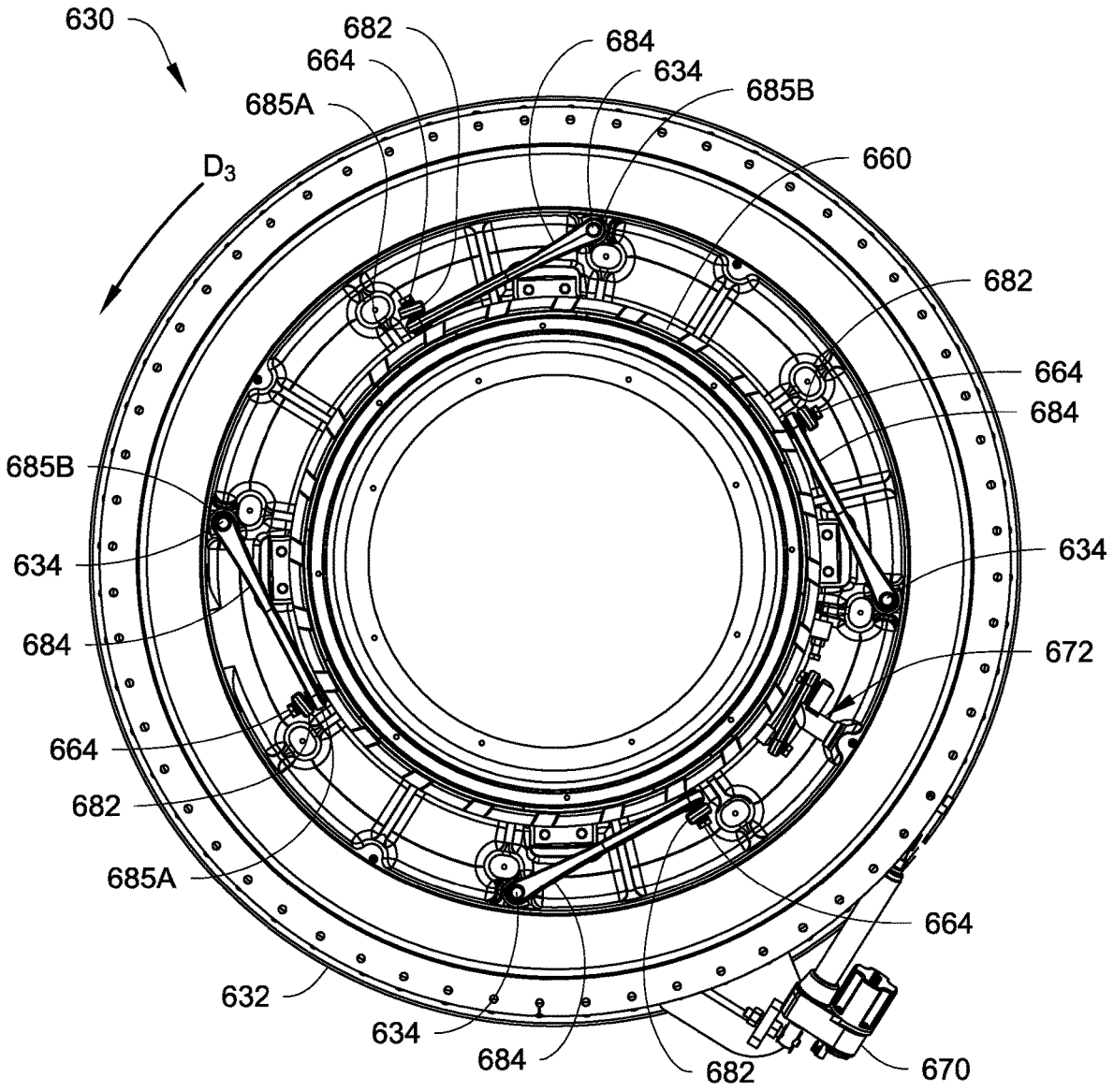
FIG. 8 is front view section view of the throttle ring, the actuation mechanism, and a housing of a interstage throttle of the centrifugal compressor in FIG. 6 according to an embodiment.
Figure 9:
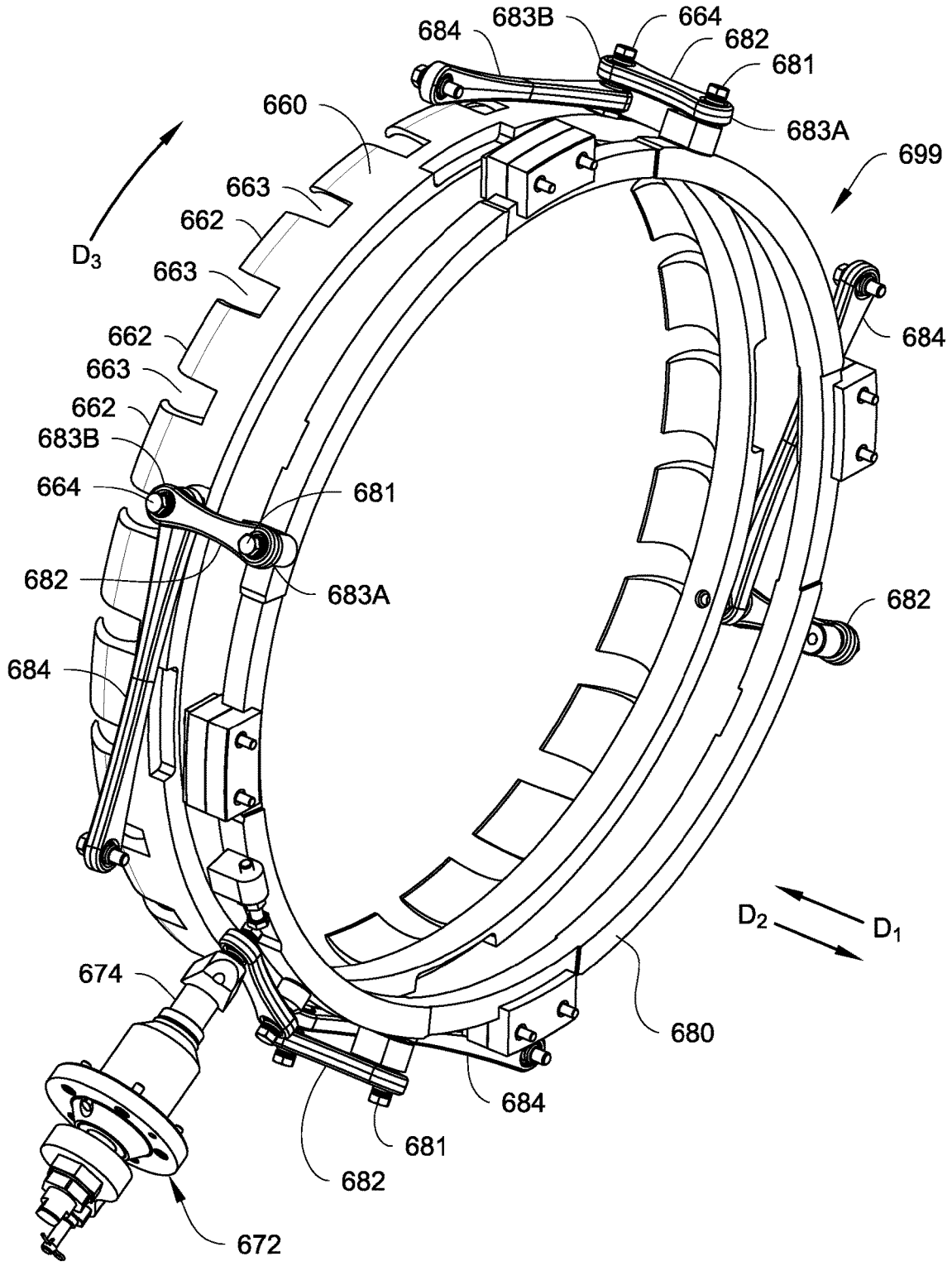
FIGS. 9 and 10 are each a rear perspective view of the throttle ring and the actuation mechanism of the interstage throttle in FIG. 8 according to an embodiment.
Figure 10:
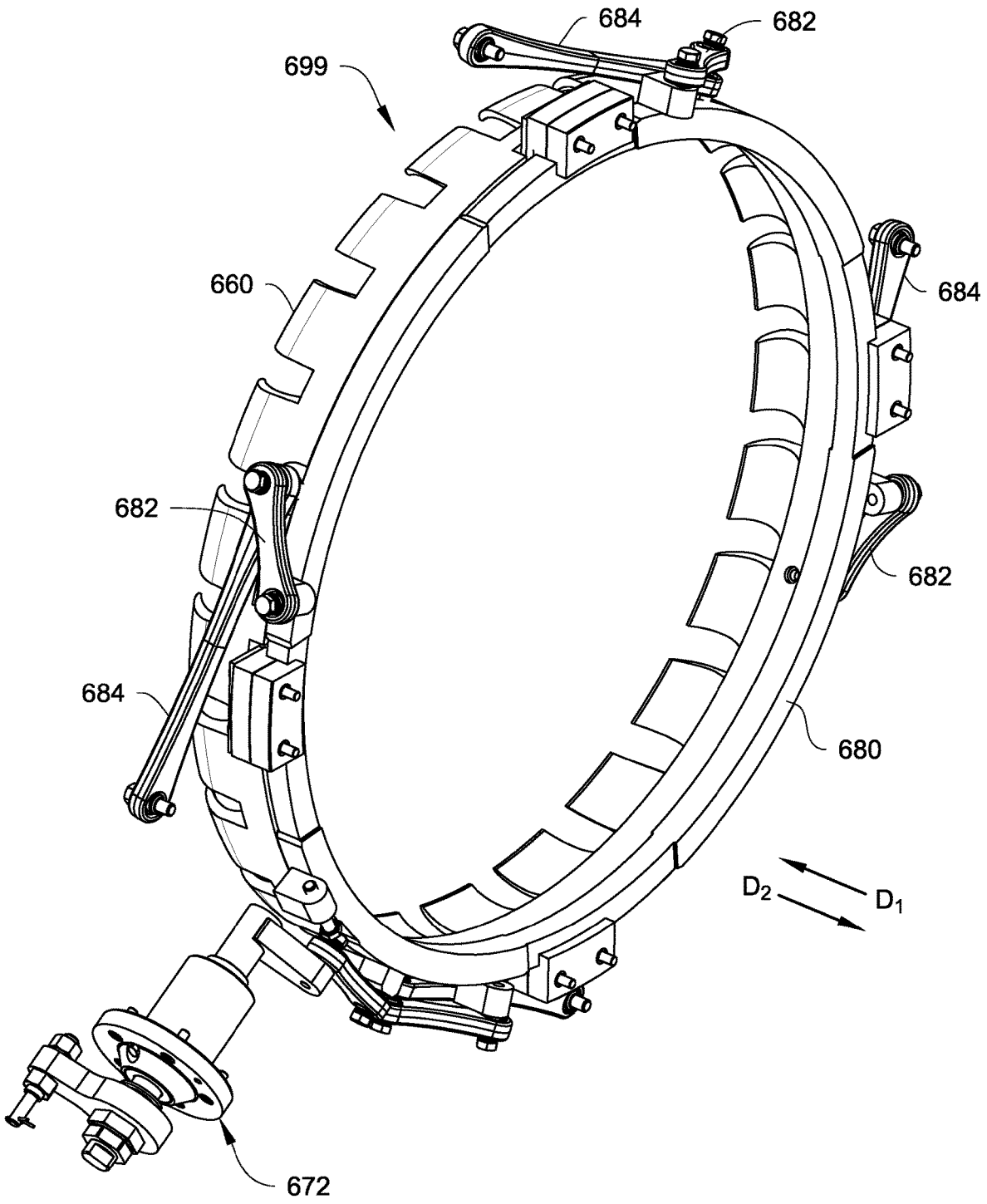

FIGS. 8-10 show an embodiment of a capacity control valve and an actuation mechanism 699 for the capacity control valve of the interstage throttle 630. The capacity control valve as described herein can have a ring shape and be referred to as a throttle ring 660. Throttle ring 660 can be, for example, the capacity control valve 116 or the capacity control valve 216 as described above and shown in FIGS. 1A-1D and 2A-2D.

FIG. 8 is front view section view of the throttle ring 660, the actuation mechanism 699, and a housing 632 of the interstage throttle 630. The interstage throttle 630 includes the housing 632. Housing 632 shown in FIG. 8 is the portion of the compressor housing 602 in FIG. 6. For example, the housing 632 remains stationary within the compressor 600 during operation (e.g., remains stationary during rotation of the shaft that drives the first stage impeller and the second stage impeller). FIG. 9 is a side perspective view of the throttle ring 660 and the actuation mechanism actuation mechanism 699 when the throttle ring 660 is in its extended position. FIG. 10 is a side perspective view of the throttle ring 660 and the actuation mechanism actuation mechanism 699 when the throttle ring 660 is in its retracted position.

The centrifugal compressor 600 can generally include features similar to the centrifugal compressors 100, 200, 302, 400, 500 in FIGS. 1A-5. For example, the centrifugal compressor 600 includes a first stage impeller, a second stage impeller, deswirl vanes and a side stream injection port located between the first stage impeller and the second stage impeller as similarly described above and shown in FIGS. 1A-2D. In an embodiment, one or more of the centrifugal compressors 100, 200, 302, 400, 500 in FIGS. 1A-5 may include the actuation mechanism 699 for operating/moving its capacity control valve 116, 216, 416, 516.

The actuation mechanism 699 is configured to axially move the throttle ring 660 as similarly described above and shown in FIGS. 1A-1D and 2A-2D for the capacity control valve 116 or capacity control valve 216. For example, the throttle ring 660 is moveable in the axial direction (e.g., positive axial direction $D_1$, negative axial direction $D_2$ in FIG. 9) between an extended position (shown in FIG. 9) and a retracted position (shown in FIG. 10). For example, the capacity control valve 216 in its fully open position in FIG. 2A is an example of the throttle ring 660 in the retracted position, and the capacity control valve 216 in its fully closed position in FIG. 2D is an example of the throttle ring 660 in the extended position. The throttle ring 660 may also include intermediate position(s) between its retracted position and its extended position as similarly shown and described for the capacity control valve 216 in FIGS. 2B and 2C.

The actuation mechanism 699 for the throttle ring 630 includes the actuation linkage assembly 672, a drive ring 680, drive linkages 682, and support linkages 684. The compressor 600 also includes an actuator 670 that operates/drives the actuation mechanism 699 to axially move the throttle ring 630 within the housing 632. The actuation linkage assembly 672 connects to the actuator 670 and extends through the housing 632. For example, the actuation linkage assembly 672 includes a shaft 674 that extends through the housing 632 and the actuation of the actuator 670 (e.g., extending, retracting) rotates the shaft 674. As shown in FIG. 8, the actuator 670 can be mounted external to the housing 632.

In the illustrated embodiment, the actuation linkage assembly 672 is configured utilize the motion of the actuator 670 (e.g., linear motion, extension, retraction, etc.) to rotate the drive ring 680. For example, the linear motion (e.g., extension, retraction, or the like) of actuator 670 rotates a shaft 672 of the actuation linkage assembly 670 and the rotation of the shaft 672 in turn rotates the drive ring 680. As shown in FIGS. 9 and 10, the drive ring 680 may have at or about the same circumference as the throttle ring 660. The drive ring 680 is obscured by the throttle ring 660 in FIG. 8. In an embodiment, the circumferences of the drive ring 680 and the throttle ring 660 are less than 10% different. In another embodiment, the circumferences of the drive ring 680 and the throttle ring 660 may be less than 5% different.

FIG. 9 shows the actuator 670 when retracted such that the throttle ring 630 is in its extended position. FIG. 10 shows the throttle ring 630 when the actuator 670 is extended and has moved the throttle ring 630 to its retracted position. For example, a controller (not shown) of the centrifugal compressor 600 and/or the HVACR controller may be configured to control the capacity of the compressor 600 by controlling the position/actuation of the actuator 670.

The linkages 682, 684 are configured to move the throttle ring 660 in the axial direction (e.g., positive axial direction $D_1$, negative axial direction $D_2$) using the rotation of the drive ring 680. The drive linkages 682 connect the drive ring 680 to the throttle ring 660. Each of the drive linkages 682 separately extends from the drive ring 680 to the throttle ring 660. As shown in FIGS. 8-10, the throttle ring 660 and the drive ring 680 each include radial shafts 664, 681 (e.g., pins, bolts, integral shafts, or the like) that extend radially outward from the throttle ring 660 and the drive ring 680, respectively. It should be appreciated that one or more of the radial shafts 664, 681 may extend radially inward in another embodiment. The linkages 682, 684 are rotatably connected to the radial shafts 664, 681 on the rings 660, 680. As shown in the FIGS. 8-10, the linkages 682, 684 can each be an arm that connects their respective structures. The linkages 682, 684 are configured to use the rotation of the drive ring 680 to move the throttle ring 660 in the axial direction with little to no rotation of the throttle ring 660.

As shown in FIG. 8, each support linkage 684 has a first end 685A that is rotatably connected to the throttle ring 660 and a second end 685B that is rotatably connected to the housing 632. For example, each support linkage 684 has a through-hole on its first end 685A that is inserted onto a respective radial shaft 664 on the throttle ring 660. For example, each support linkage 684 has a through-hole on its second end 685B that is inserted onto a respective shaft 634 on the housing 632. For example, the shaft 634 on the housing 632 extends in the axial direction (e.g., in axial direction $D_1$ in FIG. 7).

As shown in FIG. 9, each drive linkage 682 has a first end 683B that is rotatably connected to the throttle ring 660 and a second end 683A that is rotatably attached to the drive ring 680. For example, each drive linkage 682 has a through-hole on its first end 683B that is inserted onto a respective radial shaft 664 on the throttle ring 660. For example, each drive linkage 682 has a through-hole on its second end 683A that is inserted onto a respective radial shaft 681 on the drive ring 680.

As shown in FIGS. 8-10, the drive linkages 682 and support linkages 684 are provided in pairs. In each drive linkage 682 and support linkage 684 pair, the drive linkage 682 and the support linkage 684 connect to the throttle ring 660 at the same location. For example, the drive linkage 682 and the support linkage 684 in each pair is rotatably connect to the same radial shaft 664 of the throttle ring 660. The drive linkage 682 is configured to transfer the movement from the drive ring 680 (e.g., rotation of the drive ring 680) to the radial shaft 664 of the throttle ring 664 while the support linkage 684 is configured to limit/prevent rotation of the throttle ring 660. In the illustrated embodiment, the interstage throttle 630 includes 4 pairs of the drive and supports linkages 682, 684. However, it should be appreciated that the interstage throttle 630 in an embodiment may include a different number of the linkages 682, 684. For example, the interstage throttle 630 in an embodiment may include three or more pairs of the linkages 682, 684.

As shown in FIGS. 9 and 10, the linkages 682, 684 are configured so that the rotation of the drive ring 680 moves the throttle ring 664 in the axial direction with limited rotational movement. For example, the throttle ring 664 is configured to rotate less than 5 degrees between its fully retracted position to fully extend position. In an embodiment, the throttle ring 664 may be configured to rotate less than 3 degrees between its from its fully retracted position to its fully extend position. For example, the throttle ring 664 moves from its fully retracted position to its fully extended position when the actuator 670 is actuated moves from 0% extended to 100% extended, or from 100% extended to 0% extended.

As shown in FIG. 9, the throttle ring 660 includes teeth 662 that extend towards in the axial direction $D_1$. For example, the teeth 662 can be the portion of the capacity control valve 116 that is moved into the interstage flow in FIGS. 1B-1C or the portion of the capacity control valve 216 that is moved into the interstage flow in FIGS. 2B-2C. The compressor 600 also includes deswirl vanes (e.g., deswirl vanes 112, deswirl vanes 212, deswirl vanes 406, deswirl vanes 502, or the like) located between the first stage impeller (e.g., first stage impeller 104, first stage impeller 204, or the like) and the second stage impeller (e.g., second stage impeller 118, 218, or the like). The deswirl vanes may alternatively be referred to as guide vanes. The teeth 662 configured to intermesh with the guide vanes when in the extended position.

In an embodiment, the teeth 662 can include one or more of the shape feature(s) described for the capacity control valve 116 in FIGS. 1A-1D (e.g., leading end 124, trailing end 126, leading side 130, trailing side 132, curved surface 134, tip 136, and the like), and/or one of the more of the shape feature(s) of the capacity control valve 216 in FIGS. 2A-2D (e.g., leading end 224, trailing end 226, leading side 230, trailing side 232, curved surface 234, tip 236, and the like).

As shown in FIG. 9, the teeth 662 of the throttle ring 660 are spaced apart from each other in the circumferential direction $D_3$. A respective gap 663 is formed between each circumferentially adjacent pair of teeth 662. Each gap is configured to accept a respective one of the guide vanes 644 (omitted in FIG. 9) when the throttle ring 660 is in its extended position (e.g., see FIG. 12).

Figure 11:
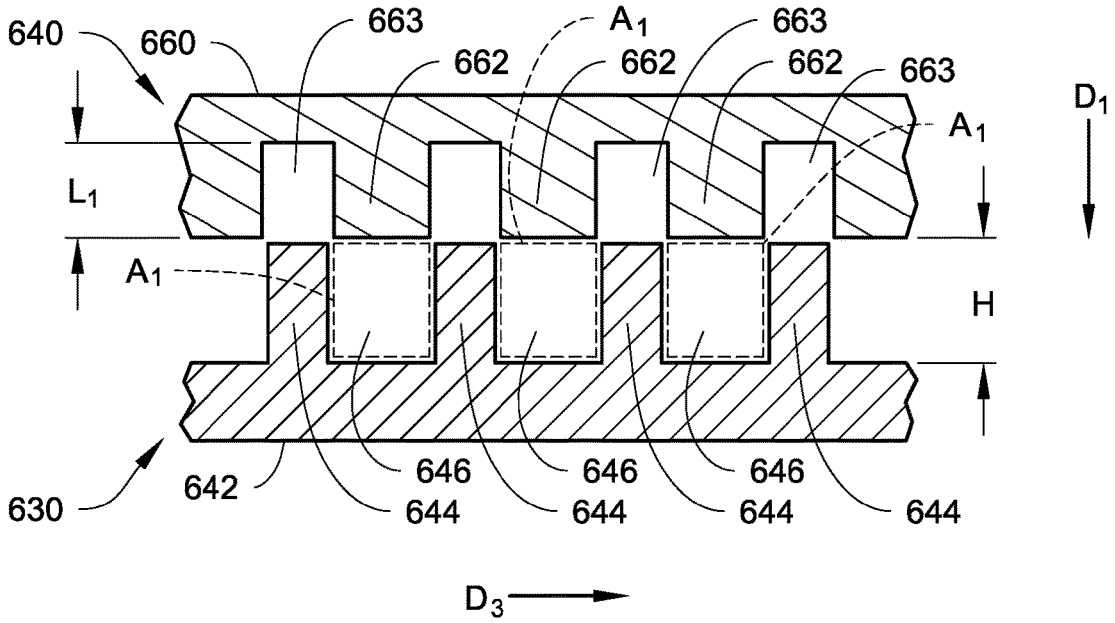
FIGS. 11 and 12 are each a schematic diagrams illustrating the intermeshing of the throttle ring and a flow guide plate of the interstage throttle of FIG. 6 according to an embodiment.
Figure 12:
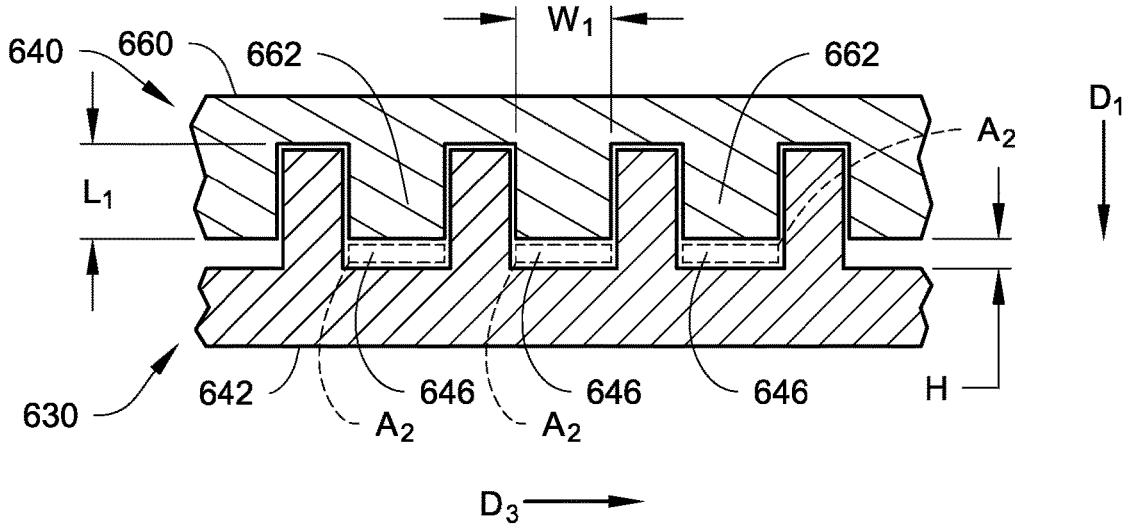

FIGS. 11 and 12 are schematics diagrams illustrating the intermeshing of the throttle ring 660 and the guide vanes 644. For example, the view in FIGS. 11 and 12 is a partial cross section extending in the circumferential direction along the teeth 662 of the throttle ring 660 and the guide vanes 664. For example, FIG. 11 shows the throttle ring 660 in the retracted position (e.g., as shown in FIG. 10). FIG. 12 shows the throttle ring 660 in the extended position (e.g., shown in FIG. 9)

As shown in FIG. 11, channels 646 are formed by the guide vanes 644. The channels 646 spiral extend radially inward (e.g., see the channels formed between each adjacent pair of deswirl vanes 502 in FIG. 5). More specifically, the channels extend radially inward by spiraling radially inward. The compressed interstage fluid flows from the first stage impeller to the second stage impeller by flowing through the channels 646. For example, FIGS. 1B-1D show the tip 136 of the capacity control valve 116 disposed in one of the channels formed between the deswirl vanes 112. The flow direction of interstage flow of the fluid from the first impeller stage to the second impeller stage would be into the page in FIGS. 11 and 12. For example, radially inward is into the page in FIGS. 11 and 12.

The teeth 662 of the throttle ring 660 are spaced apart from each other in the circumferential direction $D_3$. The guide vanes 644 are space apart from each other in the circumferential direction $D_3$ such that the channels 646 are spaced apart from each other in the circumferential direction $D_3$. Each of the teeth 662 has a width $W_1$ in the circumferential direction that is smaller than the width $W_2$ of its respective channel 646 such that the teeth 662 fit into their respective channels 646. The teeth 662 intermesh with the channels 646 when the throttle ring is in its extended position (e.g., as shown in FIG. 12).

Referring to FIG. 11, the compressor 600 may include the guide vanes 644 as part of a guide flow plate 640. The guide flow plate 640 can include a baseplate 642 and the guide vanes 644 being provided on the baseplate 642. The guide vanes 644 provided on the baseplate 642 extend/swirl radially inward along the baseplate 642 (e.g., the deswirl vanes 502 provided on a baseplate in FIG. 5 in which the sectional view of FIG. 5 removes a portion of the baseplate). Each of the channels 646 has a cross sectional area $A_1$ when the throttle ring 660 is in in its retracted position. The fluid flows through the channels 646 by passing through the cross-sectional area $A_1$ between the flow guide plate 640 and the tips 664 of the teeth 662. In the illustrated embodiment, the teeth 662 of the throttle ring 660 are not disposed in the channels 646 when the throttle ring 660 is in its retracted position. However, it should be appreciated that the throttle ring 660 in an embodiment may be configured such that the ends of the teeth 662 remain in the channels 646 when in the retracted position.

When actuated into the extended position as shown in FIG. 12, the throttle ring 660 moves closer to the flow guide plate 640 in the axial direction $D_1$ and the teeth 662 are disposed in the channels 646. The movement of the throttle ring 660 disposes a greater length $L_1$ of the teeth 662 in the channels 646 and moves the teeth 662 closer to the baseplate 142 of the flow guide plate 640. The teeth 662 and channels 646 intermesh together in the extended position. Each tooth 662 is disposed in its respective channel 646 and between a respective adjacent pair (e.g., adjacent in the circumferential direction $D_3$) of the guide vanes 644.

When moved to the extended position, the teeth 662 partially block the channels 646 and reduce the open height H of the channels. The blocking of the channels 646 reduces their open cross sectional area $A_2$ at the teeth 662. This creates reduces a pressure drop for the fluid to flow through the smaller cross sectional area $A_2$ which reduces the flow rate of the fluid through the channels 646 (e.g., reduces the flowrate of fluid in the interstage flow).

Figure 13:
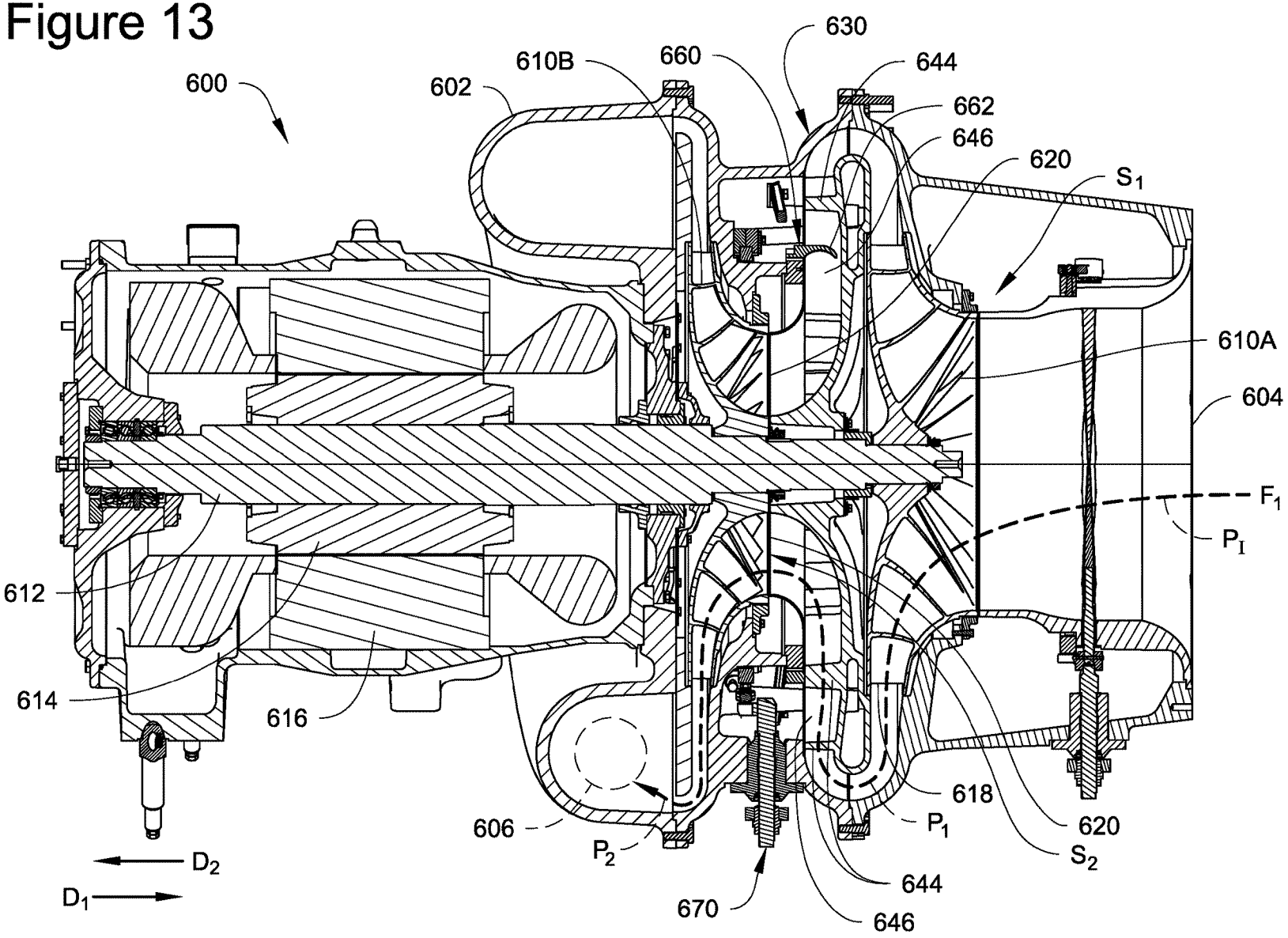
FIG. 13 is a cross-sectional view of the centrifugal compressor of FIG. 6 as indicated in FIG. 7 according to an embodiment.

FIG. 13 is a cross-sectional view of the centrifugal compressor 600 as indicated in FIG. 7. As shown in FIG. 13, the compressor 600 includes the first stage $S_1$, the second stage $S_2$, and the interstage throttle 630 that connects the first stage $S_1$ to the second stage $S_2$. The first stage $S_1$ includes the first stage impeller 610A and the second stage $S_2$ includes the second stage impeller 610A which rotate to compress the fluid in their respective stage $S_1$, $S_2$.

The compressor 600 also includes a driveshaft 612, a rotor 614, and a stator 616. The impellers 610A, 610B are each affixed to the driveshaft 612. For example, the first stage impeller 610A is affixed to an end of the driveshaft 612 while the second stage impeller 610B is affixed closer to a middle of the shaft 612. The rotor 614 is attached to the driveshaft 612 and is rotated by the stator 616, which rotates driveshaft 612 and the impellers 610A, 610B. The rotor 614 and stator 616 form an electric motor of the compressor 610. The electric motor (e.g., the stator 616 and the rotor 614) operates according to generally known principles. In another embodiment, the driveshaft 612 may be connected to and rotated by an external electric motor, an internal combustion engine (e.g., a diesel engine or a gasoline engine), or the like. It is appreciated that in such embodiments that the rotor 614 and the stator 616 would not be present within the housing 602 of the compressor 600. The driveshaft 612 extends through the first and second stages $S_1$ and $S_2$ as well as the interstage throttle 630 as shown in FIG. 13. It should be appreciated that the terms "axial", "radial", and "circumferential" as used herein are generally with respect to the axis of the compressor 600 (e.g., the axis of the driveshaft 612), unless specified otherwise.

The flow path $F_1$ of working fluid through the compressor 600 is indicated in dashed arrows in FIG. 13. The flow path $F_1$ extends from the suction inlet 604 to the discharge outlet 606 of the compressor 600. The working fluid enters the compressor 600 through the suction inlet 604, is compressed within the first stage $S_1$ by the first impeller 610A, flows through the interstage throttle 630 to the second stage $S_2$, is further compressed in the second stage $S_2$ by the second stage impeller 610B, and is then discharged from the compressor 600 through the discharge outlet 606. The first stage impeller 610A in the first stage $S_1$ is configured to compress the working fluid from an inlet pressure (e.g., pressure $P_1$) to a first pressure $P_1$, and the second stage impeller 610B in the second stage $S_2$ is configured to further compress the working fluid to a second pressure $P_2$ that is greater than the first pressure $P_1$. As similarly discussed above, the side stream of intermediate pressure working fluid can flow (depending on the position of the throttle ring 630) into the flow path $F_1$ between the first stage impeller 610A and the second stage impeller 610A. The pressure of the working fluid flowing into the inlet 620 of the second stage impeller 610A may be different from the first pressure $P_1$ (e.g., can be a pressure between the pressure of the intermediate working fluid and the first pressure $P_1$).

In flow path $F_1$, the interstage throttle 630 is disposed between the first stage impeller 610A of the first stage $S_1$ and the second stage impeller 610B of the second stage $S_2$. The interstage throttle 630 is disposed between the outlet 618 of the first impeller $S_1$ and the inlet 620 of the second impeller 610B. The driveshaft 612 extends through the interstage throttle 630. The interstage throttle 630 fluidly connects the outlet 618 of the first stage impeller 610A to the inlet 620 of the second stage impeller 610B. The interstage throttle 630 directs the working fluid discharged from the first stage $S_1$ (e.g., the compressed working fluid at the first pressure $P_1$) to the second stage impeller 610B of the second stage $S_2$. For example, the interstage throttle 630 directs the compressed working fluid (after being discharged radially outward from the first stage impeller 610A) radially inward to the inlet 620 of the second stage impeller 610B. The interstage throttle 630 also directs the intermediate pressure working fluid to the second stage impeller 610B. For example, the interstage throttle 630 directs the intermediate pressure working fluid into the stream of compressed working fluid flowing from the first stage impeller 610A to the second stage impeller 610B, and then directs the mixture of intermediate pressure working fluid and compressed working fluid radially inward to the inlet 620 for the second stage impeller 610A. The intermediate working fluid can mix with the compressed working fluid from the first stage impeller 610A as the within the channels 646.

The interstage throttle 630 is adjustable to control the flowrate of the compressed working fluid flowing from the first stage $S_1$ to the second stage $S_2$ and the flowrate of the intermediate working fluid into the second stage $S_2$ (e.g., the flowrate of the intermediate working fluid into the compressor 600). The interstage throttle 630 includes the actuator 670 for operating the interstage throttle 630. The actuator 670 is operable/actuates to adjust the flowrate of the compressed working fluid flowing through the interstage throttle 630. For example, a controller (not shown) of the compressor 600 and/or the HVACR controller may be configured to control the capacity of the compressor 600 by controlling the position/actuation of the actuator 670.

The interstage throttle 630 includes the flow guide plate 640 with the guide vanes 644 and the channels 646 formed by the guide vanes 644. The channels 646 spiral radially inward as discussed above. As shown in FIG. 13, the working fluid flows through interstage throttle 630 by flowing through the channels 646. The channels 646 direct the working fluid discharged from the first stage $S_1$ radially inward to the inlet 620 of the second stage impeller 610B. The interstage throttle 630 includes the throttle ring 660 configured to be actuated to adjust a size of the channels 646 (e.g., the cross-sectional area of the channels 646).

The throttle ring 660 includes the teeth 662 that extend towards the flow guide plate 640. The throttle ring 660 is configured to be actuated in the axial direction (e.g., in the positive axial direction $D_1$, in the negative axial direction $D_2$) relative to the channels 646. The axial movement of the throttle ring 660 changes the length of the teeth 662 disposed in the channels 646 to adjust the cross-sectional area of the channels 646. For example, when the throttle ring 660 is actuated towards the channels 646 (e.g., in a positive axial direction $D_1$), the teeth 662 extend further into the channels 646 and reduce the cross-sectional area of the channels 646. As each tooth 662 is disposed further into its respective channel 646, the tooth 662 partially blocks more of the channel 646 and decreases the cross-sectional area of the channel 646 (e.g., decreases the open cross-sectional area in each channel 646). The decreased cross-sectional area of the channels 646 decreases the flowrate of the working fluid through the channels 646 and the interstage throttle 630. When the throttle ring 660 is actuated away from the channels 646 (e.g., in the negative axial direction D2), the teeth 662 extend less into the channels 646 and the cross-sectional area of the channels 646 is increased, which increases the flow of the working fluid through the interstage throttle 630. For example, the throttle ring 660 in an embodiment may have the retracted position in which the teeth 662 are disposed entirely outside of the channels 646.

Figure 14:
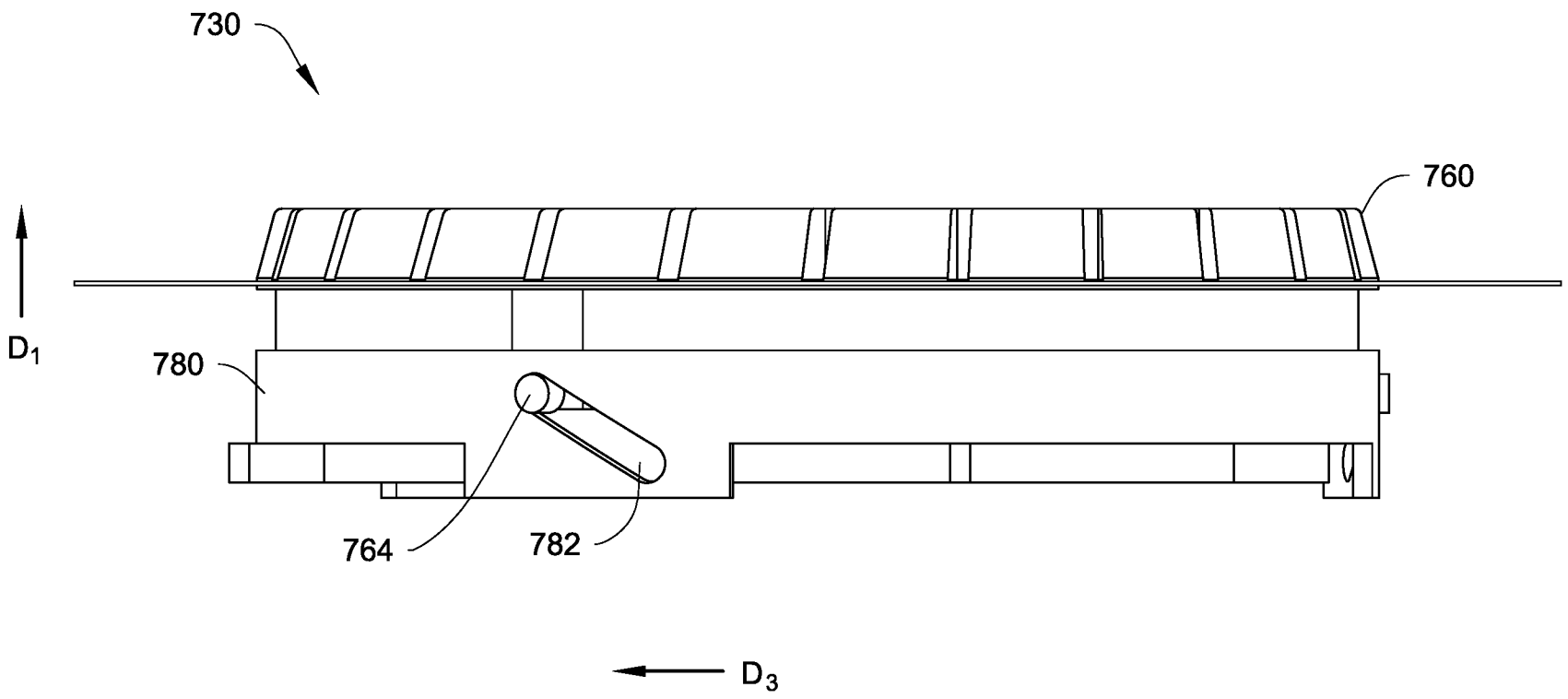
FIG. 14 is a side view of an embodiment of a throttle ring and a drive ring for an interstage throttle.

FIG. 14 is a side view of another embodiment of a drive linkage 782 for connecting a drive ring 780 to a throttle ring 760 in an interstage throttle 730. For example, the interstage throttle 730 may have features similar to the interstage throttle in FIGS. 6 and 8 except as described below. The throttle ring 760 is actuated by rotating the drive ring 780. For example, the rotational axis of the drive ring 780 would extend vertically in FIG. 14 such that rotation of the drive ring 780 in the circumferential direction $D_3$ would cause the left side of the drive ring 780 to move into the page and the right side of the drive ring 780 to move out of the page. For example, an actuator and actuation linkage assembly similar to the actuator 670 and actuation linkage assembly 672 as described above can be used to drive the drive ring 780 to rotate. The rotation of the drive ring 780 causes the throttle ring 760 to move in the axial direction (e.g., positive axial direction $D_1$). FIG. 14 shows the throttle ring 760 in its extended position. The throttle ring 760 is moved in the axial direction (e.g., opposite to the positive axial direction $D_1$) by rotating the drive ring 780 in the opposite direction (e.g., opposite to the circumferential direction $D_3$).

In the illustrated embodiment, the drive linkage 782 is a slot in the drive ring 780. A radial shaft 764 of the throttle ring 760 extends through the slot. The slot is angled between the axial direction $D_1$ and circumferential direction $D_3$ such that the rotation of drive ring 780 forces the radial shaft 764 to move axially within the slot which moves the throttle ring 760 in the axial direction $D_1$. In FIG. 14, the drive ring 780 has been rotated in a first direction (e.g., circumferential direction $D_3$) to move the radial shaft 764 to the end of the slot closest to the throttle ring 760 (e.g., to move the throttle ring 760 to its extended position). The drive ring 780 is then rotated in the opposite direction (e.g., opposite to the circumferential direction $D_3$ in FIG. 14) moving the radial shaft 764 in the opposite direction until reaching the end of the slot farthest from the throttle ring 760 (e.g., moving the throttle ring 760 to its retracted position). A respective drive linkage 782 (e.g., a respective slot in the drive ring 780) can be provided for each radial shaft 764 of the throttle ring 760 as similarly discussed for the drive linkages in FIGS. 8-10. In an embodiment, support linkages (e.g., support linkages 184) can be provided for the radial shafts 764 on throttle ring 760 similar to the throttle ring 660 in FIGS. 8-10 such that the rotation of the throttle ring 760 when actuated in the axial direction is limited. For example, a support linkage is provided for the radial shaft 764 that limits/prevents the radial shaft 764 in the circumferential direction $D_3$ while allowing the radial shaft 764 to move axially within the slot when the drive ring 780 is rotated.

Figure 15:
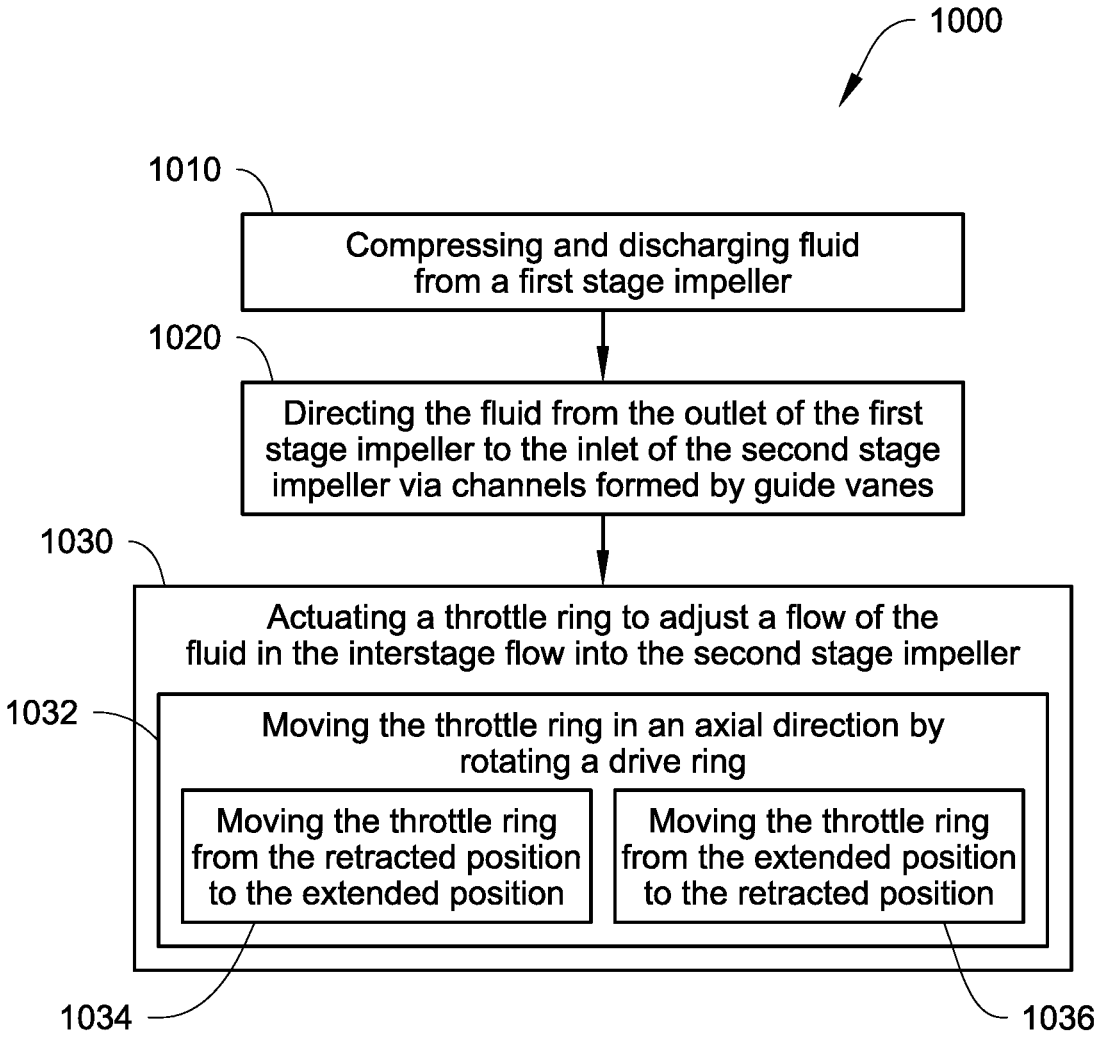
FIG. 15 is a block flow diagram for an embodiment of a method of operating a centrifugal compressor.

FIG. 15 is a block diagram of an embodiment of a method 1000 of operating a centrifugal compressor. In an embodiment, the method 1000 may be applied to the centrifugal compressor 600 of FIGS. 6-13. The method starts at 1010.

At 1010, fluid (e.g., working fluid) is compressed by and discharged from a first stage impeller of the compressor (e.g., first stage impeller 104, first stage impeller 204, first stage impeller 610A). Compressing the fluid in the first stage 1010 can include rotating the first stage impeller. The rotating of the first impeller at 1012 compresses the fluid from an inlet pressure (e.g., inlet pressure $P_I$) to a higher pressure (e.g., first pressure $P_1$) and radially discharges the compressed fluid from the first stage impeller 1012. The method 1010 then proceeds from 1010 to 1020.

At 1020, the compressed fluid is directed from the outlet of the first stage impeller to the inlet of the second stage impeller of the compressor (e.g., second stage impeller 118, second stage impeller 218, second stage impeller 610B) via channels (e.g., channels 646) formed by guide vanes (e.g., deswirl vanes 112, deswirl vanes 212, deswirl vanes 406, deswirl vanes 502, guide vanes 644). The compressed fluid flows from the first stage impeller to the second stage impeller by passing through the channels. The method 1000 then proceeds from 1020 to 1030.

At 1030, a throttle ring is actuated to adjust a flow of the fluid in the interstage flow into the second stage impeller. Actuating the throttle ring at 1030 includes moving the throttle ring in an axial direction between a retracted position and an extended position by rotating a drive ring (e.g., drive ring 680, drive ring 780) 1032. The rotation of the drive ring is configured to cause the throttle ring to move in the axial direction. The actuation of the throttle ring at 1030 also adjusts the flow of intermediate pressure working fluid into the inlet of the second stage impeller. For example, the actuation of the throttle ring at 1030 adjusts how much the of a side stream injection port from which the intermediate pressure working fluid flows (e.g., side stream injection port 114, side stream injection port 214) is blocked/obstructed by the throttle ring (e.g., see FIGS. 1A-2D).

The moving of the throttle ring in the axial direction between a retracted position and an extended position at 1032 can include moving the throttle ring from the retracted position to the extend position 1034 and/or moving the throttle ring from the extended position to the retracted position 1036. Moving the throttle ring from the retracted position to the extended position at 1034 moves teeth of the throttle ring (e.g., teeth 662) in the axial direction into the channels (e.g., from outside of the channels into the channels, further into the channels, or the like). Moving the throttle ring from the extended position to the retracted position at 1036 withdraws the teeth of the throttle ring from the channels in the axial direction (e.g., partially withdraws the teeth from the channels, fully withdraws the teeth form the teeth, etc.). In an embodiment, moving the throttle ring from the extended position to the retracted position at 1036 includes moving the teeth along the axial direction into the side stream injection port.

In an embodiment, moving the throttle ring between the retracted position and the extended position by rotating the drive ring at 1032 includes extending an actuator (e.g., actuator 670) to rotate the drive ring in a first direction and retracting the actuator to rotate the drive in an opposite direction.

It should be appreciated that the method 1000 in an embodiment may be modified to have features as discussed above for the centrifugal compressor 100 in FIGS. 1A-1D, the centrifugal compressor in FIGS. 2A-2D, the centrifugal compressor 300 in FIG. 3, the centrifugal compressor 400 in FIG. 4, the centrifugal compressor 400 in FIG. 5, the centrifugal compressor 600 in FIGS. 6-11, and/or the centrifugal compressor 730 in FIG. 11.

Aspects:

It is understood that any of aspects 1-12 can be combined with any of aspects 13-34, any of aspects 13-19 can be combined with any of aspects 20-34, and any of aspects 20-30 can be combined with any of aspects 31-34.

Aspect 1. A centrifugal compressor, comprising:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, wherein:

the capacity control valve has a curved surface facing a direction of flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

Aspect 2. The centrifugal compressor according to aspect 1, wherein the capacity control valve has a ring shape.

Aspect 3. The centrifugal compressor according to any of aspects 1-2, comprising a plurality of the side stream injection ports and a plurality of the capacity control valves.

Aspect 4. The centrifugal compressor according to any of aspects 1-3, wherein in the open position, a tip of the capacity control valve at an end of the curved surface is within the side stream injection port.

Aspect 5. The centrifugal compressor according to any of aspects 1-4, wherein the capacity control valve extends and retracts in a direction substantially perpendicular to the direction of flow from the first stage impeller to the second stage impeller.

Aspect 6. The centrifugal compressor according to any of aspects 1-5, further comprising one or more deswirl vanes between the first stage impeller and the second stage impeller.

Aspect 7. The centrifugal compressor according to aspect 6, wherein the capacity control valve includes one or more notches, the one or more notches each configured to accommodate at least a portion of one of the one or more deswirl vanes.

Aspect 8. The centrifugal compressor according to any of aspects 6-7, wherein the one or more deswirl vanes each include one or more notches, the one or more notches each configured to accommodate at least a portion of the capacity control valve.

Aspect 9. The centrifugal compressor of any of aspects 1-8, wherein the capacity control valve has a linear meridional profile on a side opposite the curved surface, the linear meridional profile contacting an edge of the side stream injection port.

Aspect 10. The centrifugal compressor of any of aspects 1-9, wherein a side of the capacity control valve opposite the curved surface is configured such that when the capacity control valve is between the open position and the closed position, the fluid can flow past the capacity control valve on the side of the capacity control valve opposite the curved surface.

Aspect 11. The centrifugal compressor according to aspect 10, wherein the side of the capacity control valve opposite the curved surface includes a second curved surface.

Aspect 12. The centrifugal compressor according to any of aspects 10-11, wherein the side of the capacity control valve opposite the curved surface includes one or more channels configured to allow flow of the side stream of the fluid.

Aspect 13. A heating, ventilation, air conditioning, and refrigeration (HVACR) circuit, comprising:

a centrifugal compressor;

a condenser;

an expander; and an evaporator, wherein the centrifugal compressor includes:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, the capacity control valve has a curved surface facing a direction of flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

Aspect 14. The HVACR circuit according to aspect 13, wherein the side stream of the fluid is from the condenser to the side stream injection port.

Aspect 15. The HVACR circuit according to aspect 13, further comprising an economizer and wherein the side stream of the fluid is from the economizer to the side stream injection port.

Aspect 16. The HVACR circuit according to aspect 13, further comprising an intercooler and wherein the side stream of the fluid is from the intercooler to the side stream injection port.

Aspect 17. The HVACR circuit according to any of aspects 13-16, wherein the capacity control valve has a ring shape.

Aspect 18. The HVACR circuit according to any of aspects 13-17, wherein the capacity control valve has a linear meridional profile on a side opposite the curved surface, the linear meridional surface contacting an edge of the side stream injection port.

Aspect 19. The HVACR circuit according to any of aspects 13-17, wherein a side of the capacity control valve opposite the curved surface is configured such that when the capacity control valve is between the open position and the closed position, the fluid can flow past the capacity control valve on the side of the capacity control valve opposite the curved surface.

Aspect 20. A centrifugal compressor for compressing a fluid, comprising:

a first stage impeller;

a second stage impeller;

a plurality of guide vanes forming channels located between the first stage impeller and the second stage impeller, the channels configured to direct an interstage flow of the fluid from the first stage impeller to the second stage impeller;

a side stream injection port located between the first stage impeller and the second stage impeller, the side stream injection port configured to receive a side stream of the fluid; and a throttle ring configured to move through the side stream injection port between an extended position and a retracted position, a drive ring; and linkage assemblies connecting the drive ring to the throttle ring such that rotation of drive ring moves the throttling ring in the axial direction between the retracted position and the extended position, wherein in the extended position, the throttle ring obstructs flow of the side stream of the fluid through the side stream injection port and partially obstructs the interstage flow of the fluid through the channels, and in the retracted position, the throttle ring allows the side stream of the fluid to flow through the side stream injection port.

Aspect 21. The centrifugal compressor of Aspect 20, wherein the throttle ring includes teeth, and in the extended position, the teeth of the throttle ring are disposed in and obstruct the channels.

Aspect 22. The centrifugal compressor of Aspect 21, wherein the teeth extend in the axial direction and include tips that curve radially inward.

Aspect 23. The centrifugal compressor of any one of Aspects 21 and 22, wherein in the retracted position, the teeth of the throttle ring are disposed in the side stream injection port.

Aspect 24. The centrifugal compressor of any one of aspects 21-23, wherein the teeth of the throttle ring obstruct less of the channels in the retracted position than in the extended position, and the throttle ring obstructs more of the side stream injection port in the retracted position than in the extended position.

Aspect 25. The centrifugal compressor of any one of aspects 21-24, wherein in the retracted position, the fluid in the side stream flows over the throttle ring into the side stream injection port, and in the extended position, the fluid in the interstage flow passing through the channels by flowing across the tips of the teeth.

Aspect 26. The centrifugal compressor of any one of aspects 21-25, wherein in the retracted position, the throttle ring blocks the side stream injection port Aspect 27. The centrifugal compressor of claim 1, wherein in the retracted position:

the interstage flow of the fluid from the first stage impeller has a higher flowrate in the extended position, and the side stream has a higher flowrate through the side stream injection port than in the extended position Aspect 28. The centrifugal compressor of any one of aspects 21-27, wherein the throttle ring includes radial shafts, each of the linkage assemblies include pairs of a drive linkage and a support linkage connected to the radial shafts of the throttle ring, the drive linkage and the support linkage in each of the pairs connected to the same respective one of the radial shafts on the throttle ring.

Aspect 29. The centrifugal compressor of aspect 28, further comprising:

a housing, the throttle ring, the drive ring, and the guide vanes disposed within the housing, wherein the drive linkages connect the drive ring to the throttle ring, the drive linkages configured to transfer rotation of the drive ring into axial movement of the throttle ring, and the support linkages connect the throttle ring to the housing, the support linkages configured to prevent rotation of the throttle ring.

Aspect 30. The centrifugal compressor of any one of aspects 21-29, further comprising:

an actuator and an actuation linkage assembly connecting the actuator to the drive ring, the actuator configured to extending causing the rotation of the drive ring and configured to retract causing an opposite rotation of the drive ring.

Aspect 31. A method of operating a centrifugal compressor, the centrifugal compressor including a first stage impeller, a second stage impeller, and a plurality of guide vanes and a side stream injection port each respectively located between the first stage impeller and the second stage impeller, and the method comprising:

compressing a fluid with the first stage impeller;

directing, via channels formed by the plurality of guide vanes, an interstage flow of the fluid discharged from the first stage impeller to an inlet of the second stage impeller; and actuating a throttle ring to adjust a flow of the fluid in the interstage flow into the second stage impeller, the centrifugal compressor including the throttle ring, a drive ring, and linkage assemblies connecting the drive ring to the throttle ring, and the actuating of the throttle ring including:

moving the throttle ring in an axial direction between a retracted position and an extended position by rotating the drive ring, the rotation of the drive ring causing the throttle ring to move in the axial direction, wherein in the extended position, flow of the side stream of the fluid through the side stream injection port is obstructed by the throttle ring and flow of the interstage fluid through the channels is obstructed by the throttle ring, and in the retracted position, the side stream of the fluid flows through the side stream injection port and into the inlet of the second stage impeller.

Aspect 32. The method of aspect 31, wherein the moving of the throttle ring in an axial direction between the retracted position and the extended position includes:

moving the throttle ring from the retracted position to the extended position, which includes moving the teeth into the channels, and moving the throttle ring from the extended position to the retracted position, which includes withdrawing the teeth from the channels.

Aspect 33. The method of any one of aspects 31 and 32, wherein moving the throttle ring from the extended position to the retracted position includes moving the teeth along the axial direction into the side stream injection port.

Aspect 34. The method of any one of aspects 31-33, wherein the centrifugal compressor includes an actuator and an actuation linkage assembly connecting the actuator to the drive ring, and the moving of the throttle ring in the axial direction between the retracted position and the extended position by rotating the drive ring includes:

extending the actuator to rotate the drive ring in a first direction, and retracting the actuator to rotate the drive ring in an opposite direction.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A centrifugal compressor for compressing a fluid, comprising:

a first stage impeller;

a second stage impeller;

a plurality of guide vanes forming channels located between the first stage impeller and the second stage impeller, the channels configured to direct an interstage flow of the fluid from the first stage impeller to the second stage impeller;

a side stream injection port located between the first stage impeller and the second stage impeller, the side stream injection port configured to receive a side stream of the fluid;

a drive ring including radial shafts; and a throttle ring configured to move through the side stream injection port between an extended position and a retracted position, the throttle ring including slots, the radial shafts of the drive ring extending through the slots in the throttle ring to form drive linkages, the drive linkages connecting the drive ring to the throttle ring such that rotation of the drive ring moves the throttle ring in an axial direction between the retracted position and the extended position, wherein in the extended position, the throttle ring obstructs flow of the side stream of the fluid through the side stream injection port and partially obstructs the interstage flow of the fluid through the channels, and in the retracted position, the throttle ring allows the side stream of the fluid to flow through the side stream injection port.

2. The centrifugal compressor of claim 1, wherein each drive linkage of the drive linkages is formed by a respective one of the radial shafts of the drive ring extending through a respective one of the slots in the throttle ring.

3. The centrifugal compressor of claim 1, wherein the throttle ring includes teeth, and in the extended position, the teeth of the throttle ring are disposed in and obstruct the channels.

4. The centrifugal compressor of claim 3, wherein the teeth extend in the axial direction and include tips that curve radially inward.

5. The centrifugal compressor of claim 3, wherein in the retracted position, the teeth of the throttle ring are disposed in the side stream injection port.

6. The centrifugal compressor of claim 3, wherein the teeth of the throttle ring obstruct less of the channels in the retracted position than in the extended position, and the throttle ring obstructs more of the side stream injection port in the retracted position than in the extended position.

7. The centrifugal compressor of claim 3, wherein in the retracted position, the fluid in the side stream flows over the throttle ring into the side stream injection port, and in the extended position, the fluid in the interstage flow passes through the channels by flowing across tips of the teeth.

8. The centrifugal compressor of claim 1, wherein in the retracted position, the throttle ring blocks the side stream injection port.

9. The centrifugal compressor of claim 1, wherein in the retracted position:

the interstage flow of the fluid from the first stage impeller has a higher flowrate than in the extended position, and the side stream has a higher flowrate through the side stream injection port than in the extended position.

10. The centrifugal compressor of claim 1, further comprising:

support linkages connected to the radial shafts of the throttle ring, the support linkages and the drive linkages connect to the same radial shafts of the throttle ring.

11. The centrifugal compressor of claim 1, further comprising:

a housing, the throttle ring, the drive ring, and the plurality of guide vanes disposed within the housing; and support linkages connected to the radial shafts of the throttle ring, the support linkages connect the throttle ring to the housing and being configured to prevent rotation of the throttle ring, wherein the drive linkages are configured to transfer rotation of the drive ring into axial movement of the throttle ring.

12. The centrifugal compressor of claim 1, further comprising:

an actuator and an actuation linkage assembly, the actuation linkage assembly connects the actuator to the drive ring, and the actuator configured to extend causing the rotation of the drive ring and configured to retract causing an opposite rotation of the drive ring.

13. A method of operating a centrifugal compressor, the centrifugal compressor including a first stage impeller, a second stage impeller, and a plurality of guide vanes and a side stream injection port each respectively located between the first stage impeller and the second stage impeller, and the method comprising:

compressing a fluid with the first stage impeller;

directing, via channels formed by the plurality of guide vanes, an interstage flow of the fluid discharged from the first stage impeller to an inlet of the second stage impeller; and actuating a throttle ring to adjust a flow of the fluid in the interstage flow into the second stage impeller, the centrifugal compressor including the throttle ring and a drive ring, the throttle ring including slots, the drive ring including radial shafts, the radial shafts of the drive ring extending through the slots in the throttle ring to form drive linkages that connect the drive ring to the throttle ring, and the actuating of the throttle ring including:

moving the throttle ring in an axial direction between a retracted position and an extended position by a rotation of the drive ring, the rotation of the drive ring causing the throttle ring to move in the axial direction, wherein in the extended position, flow of the side stream of the fluid through the side stream injection port is obstructed by the throttle ring and the interstage flow of the fluid through the channels is obstructed by the throttle ring, and in the retracted position, the side stream of the fluid flows through the side stream injection port and into the inlet of the second stage impeller.

14. The method of claim 13, wherein the throttle ring includes teeth, and the moving of the throttle ring in the axial direction between the retracted position and the extended position includes:

moving the throttle ring from the retracted position to the extended position, which includes moving the teeth into the channels, and moving the throttle ring from the extended position to the retracted position, which includes withdrawing the teeth from the channels.

15. The method of claim 14, wherein moving the throttle ring from the extended position to the retracted position includes moving the teeth along the axial direction into the side stream injection port.

16. The method of claim 13, wherein the centrifugal compressor includes an actuator and an actuation linkage assembly, the actuation linkage assembly connects the actuator to the drive ring, and the moving of the throttle ring in the axial direction between the retracted position and the extended position by rotating the drive ring includes:

extending the actuator to rotate the drive ring in a first direction, and retracting the actuator to rotate the drive ring in an opposite direction.

17. The method of claim 13, wherein the centrifugal compressor includes:

support linkages connected to the radial shafts of the throttle ring, the support linkages and the drive linkages connect to the same radial shafts of the throttle ring.

18. The method of claim 13, wherein the centrifugal compressor includes:

a housing, the throttle ring, the drive ring, and the plurality of guide vanes disposed within the housing, and support linkages connected to the radial shafts of the throttle ring, the support linkages and the drive linkages connect to the same radial shafts of the throttle ring, wherein the drive linkages are configured to transfer rotation of the drive ring into axial movement of the throttle ring.

19. The method of claim 13, wherein each drive linkage of the drive linkages is formed by a respective one of the radial shafts of the drive ring extending through a respective one of the slots in the throttle ring.

* * * * *